US010676976B2

(12) United States Patent
Dubach

(10) Patent No.: US 10,676,976 B2
(45) Date of Patent: Jun. 9, 2020

(54) EJECTION DEVICE FOR A MOVABLE FURNITURE PART

(71) Applicant: Julius Blum GmbH, Hoechst (AT)

(72) Inventor: Fredi Dubach, Baeretwil (CH)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/835,937

(22) Filed: Dec. 8, 2017

(65) Prior Publication Data

US 2018/0100338 A1 Apr. 12, 2018

Related U.S. Application Data

(63) Continuation of application No. PCT/AT2016/050141, filed on May 17, 2016.

(30) Foreign Application Priority Data

Jun. 9, 2015 (AT) ..... 358/2015

(51) Int. Cl.
*E05C 19/02* (2006.01)
*E05F 1/16* (2006.01)
(Continued)

(52) U.S. Cl.
CPC ..... *E05F 1/16* (2013.01); *A47B 88/463* (2017.01); *E05C 19/022* (2013.01);
(Continued)

(58) Field of Classification Search
CPC .... E05F 1/10; E05F 1/16; A47B 88/46; A47B 88/47; A47B 88/463; E05C 19/022; E05C 19/063
(Continued)

(56) References Cited

U.S. PATENT DOCUMENTS 3,551,963 A * 1/1971 Mosher, Jr. et al. ..... A44B 17/0029 24/618
9,655,447 B2 5/2017 Brunnmayr et al.
(Continued)

FOREIGN PATENT DOCUMENTS

AT 008 629 10/2006
AT 512 699 10/2013
(Continued)

OTHER PUBLICATIONS

International Search Report dated Aug. 16, 2016 in International (PCT) Application No. PCT/AT2016/050141.
(Continued)

*Primary Examiner* — James O Hansen
(74) *Attorney, Agent, or Firm* — Wenderoth, Lind & Ponack, L.L.P.

(57) ABSTRACT

The invention relates to an ejection device for ejecting a movable furniture part from a closed position into an open position along an opening path, comprising a support and a coupling device for coupling the ejection device to the movable furniture part. The coupling device has a coupling piece which can be moved relative to the support and a coupling counter piece which is arranged on the movable furniture part or on a furniture body. The coupling device has a coupling position and a decoupling position, and the ejection device can be coupled to the movable furniture part via the coupling device in the coupling position. The ejection device also comprises a controller, by means of which the coupling device can be switched depending on the opening path, and the coupling device reaches the decoupling position from the coupling position in the event of a specified opening path.

14 Claims, 36 Drawing Sheets

Figure 1:
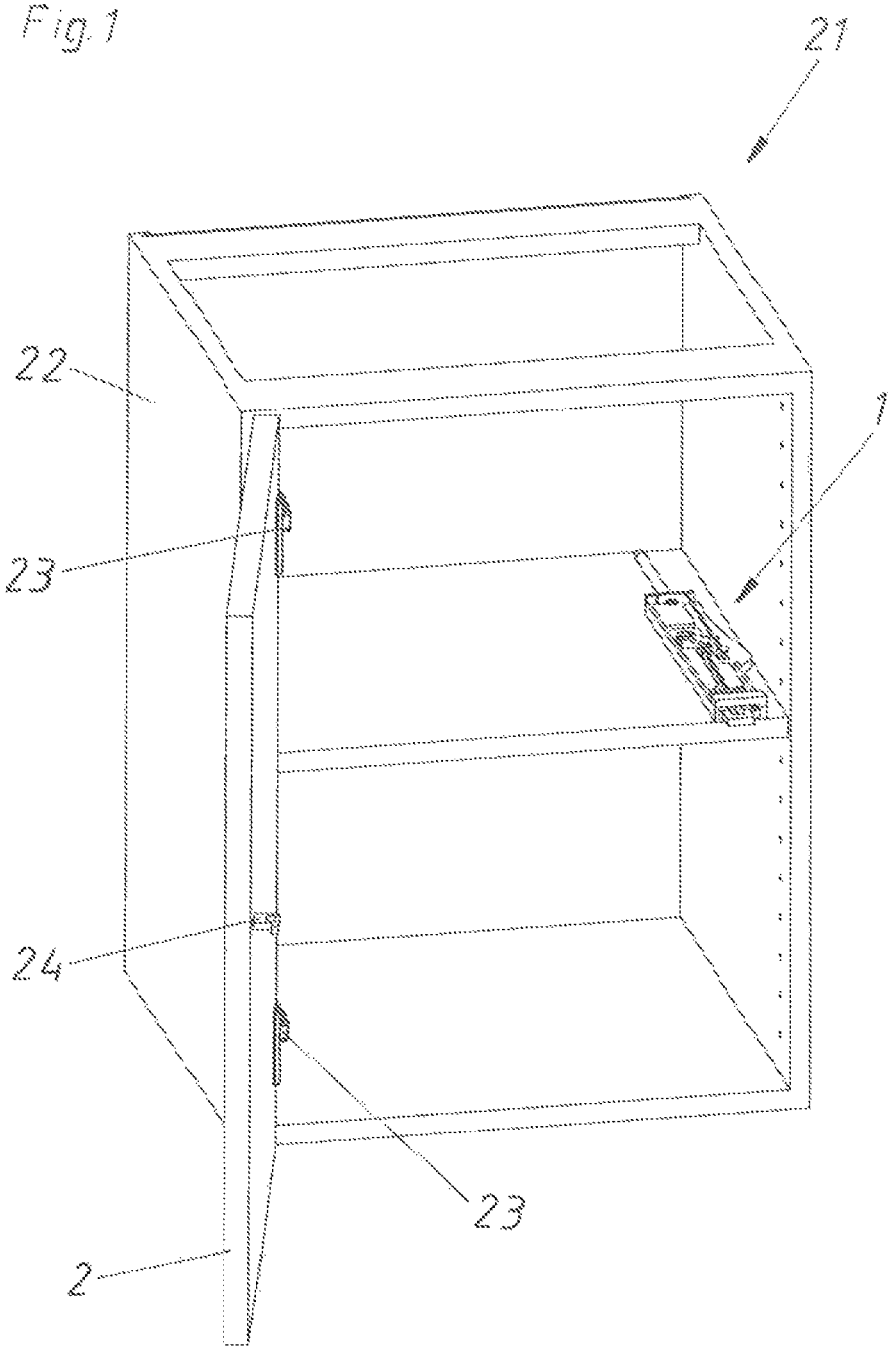

(51) Int. Cl.

| | |
|---|---|
| ***E05F 1/10*** | (2006.01) |
| ***A47B 88/463*** | (2017.01) |
| ***E05C 19/06*** | (2006.01) |
| *A47B 88/423* | (2017.01) |

(52) U.S. Cl.
CPC ..... *E05C 19/063* (2013.01); *E05F 1/10* (2013.01); *A47B 2088/4235* (2017.01); *E05Y 2900/20* (2013.01)

(58) Field of Classification Search
USPC ..... 312/330.1, 334.1, 319.1, 319.2, 334.8
See application file for complete search history.

(56) References Cited

U.S. PATENT DOCUMENTS

| | | | | |
|---|---|---|---|---|
| 9,771,750 | B2 | 9/2017 | Held | |
| 9,775,434 | B2 | 10/2017 | Flogaus | |
| 2005/0242593 | A1* | 11/2005 | Migli | E05C 19/022 292/220 |
| 2007/0113483 | A1* | 5/2007 | Hernandez | F16B 5/0664 49/502 |
| 2007/0180654 | A1* | 8/2007 | Gasser | F16H 21/40 16/242 |
| 2009/0307869 | A1 | 12/2009 | Salice | |
| 2011/0138801 | A1* | 6/2011 | Zimmer | A47B 88/457 60/527 |
| 2014/0300262 | A1 | 10/2014 | Flogaus | |
| 2015/0374124 | A1 | 12/2015 | Brunnmayr et al. | |
| 2016/0186476 | A1 | 6/2016 | Held | |

FOREIGN PATENT DOCUMENTS

| | | |
|---|---|---|
| CN | 102469880 | 5/2012 |
| DE | 20 2005 002 433 | 6/2005 |
| EP | 2 174 572 | 4/2010 |
| EP | 2 307 829 | 4/2011 |
| EP | 2 397 637 | 12/2011 |
| JP | 57-88861 | 6/1982 |
| JP | 2006-104882 | 4/2006 |
| JP | 2006-307533 | 11/2006 |
| JP | 2016-514575 | 5/2016 |
| WO | 2008/031814 | 3/2008 |
| WO | 2009/133022 | 11/2009 |
| WO | 2013/017666 | 2/2013 |

OTHER PUBLICATIONS

Search Report dated Dec. 1, 2015 in Austrian Application No. A 358/2015, with English translation.
English translation of Search Report issued with Office Action dated Nov. 26, 2018 in Chinese Application No. 201680042247.7.

* cited by examiner

SS+VS+K

ÜS+ES+K

OS+ES+K

OS+ES+K

OS + ES + K

OS + ES + K

OS+ES+K

OS+ES+K

OS+ES+K

OS+VS+K

OS+VS+EK

OS+VS+EK+R

SS+VS+K+R

SS+VS+EK

ÜS+ES+EK

OS+ES+EK

OS+ES+EK

OS+ES+K

OS+ES+K

OS+ES+K

OS+ES+K

OS + ES + K

OS + VS + EK

OS+VS+EK

OS+VS+EK

SS+VS+EK

OS+VS+EK+R

SS + VS + EK

ÜS

ÜS+ES+EK

OS + ES + K

OS + ES + K

OS + ES + EK

EJECTION DEVICE FOR A MOVABLE FURNITURE PART

The present invention concerns an ejection device for ejection a movable furniture part from a closed position into an open position along an opening path, comprising a carrier and a coupling device for coupling the ejection device to the movable furniture part, wherein the coupling device comprises a coupling piece which can be moved relative to the carrier and a coupling counter piece which is arranged on the movable furniture part or on a furniture carcass, wherein the coupling device has a coupling position and a decoupling position, and the ejection device can be coupled to the movable furniture part via the coupling device in the coupling position. Moreover, the invention concerns an item of furniture with a furniture carcass, a movable furniture part and such an ejection device.

Since many years various auxiliary means are produced and sold in the industrial sector of furniture fittings in order to support movements of the movable furniture parts and to facilitate movements for a user. For that purpose, especially in the case of ejection devices, various different variants already exist. Such ejection devices are also often referred to as touch-latch mechanisms or as tip-on devices. With such devices it is possible to press onto the movable furniture part in a closed position, whereby an unlocking of a locking device is carried out and thereby or afterwards the movable furniture parte is being ejected by the ejection device.

With many such ejection devices a tensioning of an ejection force storage member is carried out when closing, hence when the ejection device is again being actively pressed. Other known variants, however, also provide that the ejection force storage member is being tensioned directly as possible after the ejection by a continued opening movement of the movable furniture part. For that purpose, it is necessary to couple the movable furniture part to the ejection device.

A possible coupling variant of that kind is disclosed in the AT 512 699 A1. In this document a coupling element arranged on the tip of the ejection device is being coupled to an entrainment member arranged on the movable furniture part. Here, the coupling can be carried out detachably force-fitted (e. g. magnetic) or detachably positive-locking (e. g. by means of a clamping device).

Also the WO 2013/017666 A2 on the one hand discloses a magnetic coupling as the cabinet door carries a holding element directed to the front face of a tensioning rod, wherein the holding element can be formed as a magnet and moves the tensioning rod. On the other side, also a flexible positive-locking engagement is described as an end piece of an ejection element comprises latching elements which latch with counter latching elements of the holding element.

Figure 14:
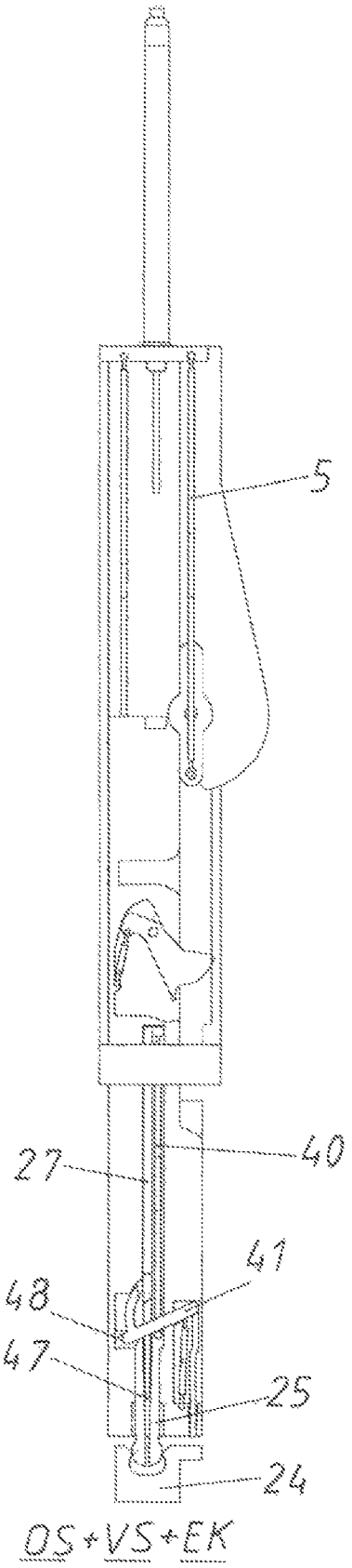
Figure 15:
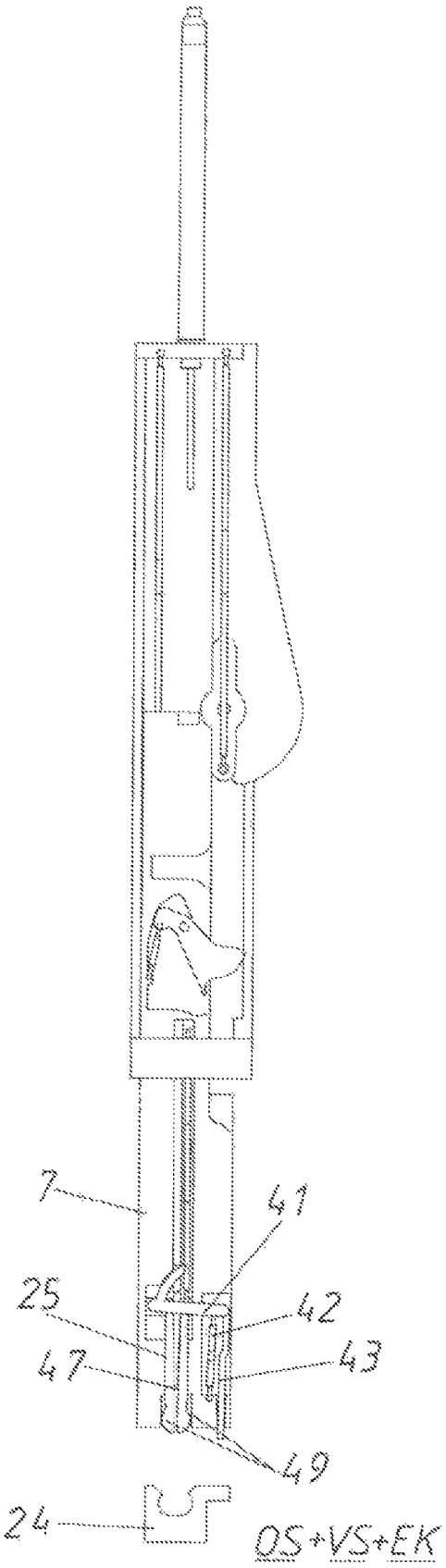
Figure 16:
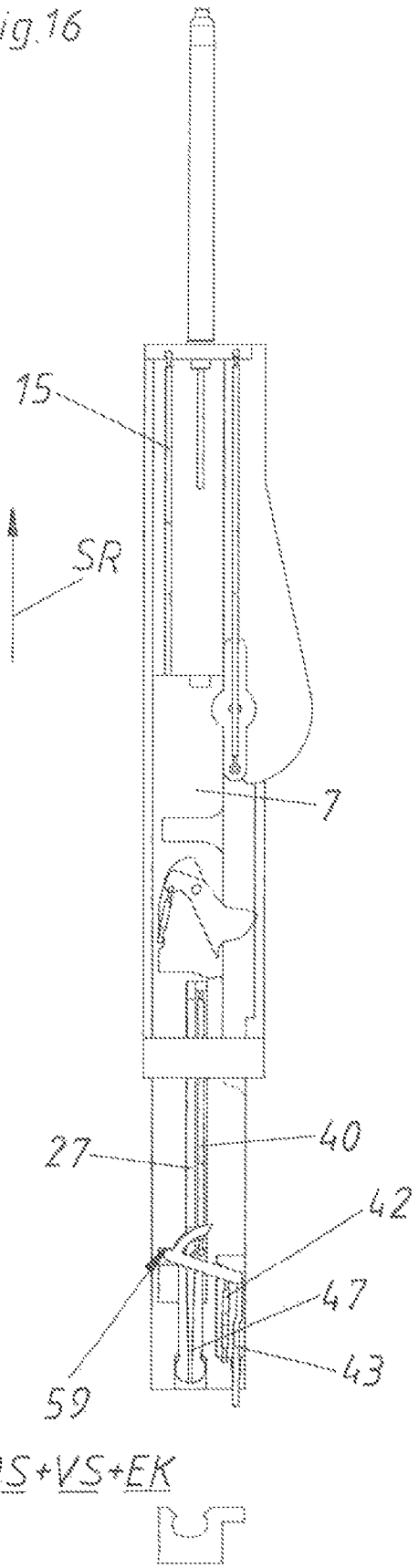

Finally, it can still be referred to the AT 008 629 U1 which shows in FIGS. 14 to 16 a positive-locking between a free end of a lever and a receiving portion arranged on the movable furniture part. The positive-locking between the free end of the lever and the receiving portion is formed detachably by the ejection force of the drive device.

In the case of the force-fitted (magnetic) coupling it is disadvantageous that the point in time of the decoupling depends on the force between the involved components. Thus, it cannot be exactly determined or adjusted at which position of the opening path the decoupling is carried out. In the case of the coupling variants referred to as positive-locking there is no actual positive-locking but rather there is a detachable latching via flexible or elastic components. Also in this case, it cannot always be exactly guaranteed at which position of the opening path the decoupling is carried out as the adjacently arranged parts are worn out because of the very often occurring coupling and decoupling movements. Especially, however, it can occur in both known variants that a decoupling already takes place undesirably too early in the event of a short-term, jerky pulling on the movable furniture part.

The object of the present invention is to provide an alternative or improved ejection device compared to the prior art. In particular, a safe, reliable and exact coupling and decoupling of the coupling device shall be guaranteed.

This is solved by an ejection device with the features of claim 1. Hence, according to the invention a control device is provided, by means of which the coupling device can be switched depending on the opening path, wherein the coupling device reaches the decoupling position from the coupling position in the event of a predetermined opening path (i.e., in the event of reaching an end of the opening path). Thus, a coupling and decoupling does not take place depending on forces directly acting on the coupling piece and on the coupling counter piece, but rather a travel-controlled coupling and decoupling is carried out. In particular, as a consequence no decoupling can happen on a wrong (too early) position of the opening path as a fix coupling is guaranteed by the control device until the switching into the decoupling position. Thus, the spot of the coupling and decoupling is exactly defined.

In principle, the exact manner of the coupling is subordinate as long as in the coupling position a decoupling is not easily possible by jerky movements or other influences. For a particularly save coupling, however, it is preferably provided that in the coupling position there is a positive-locking engagement between the coupling piece and the coupling counter piece, wherein this positive-locking engagement can be released by the control device.

The control device per se can be electronically implemented. Preferably, however, the control device is mechanically implemented. According to a preferred embodiment it is provided for a simple design that the control device comprises a coupling and decoupling element which is movable relative to the coupling piece. In this case, the coupling and decoupling element is guided and movable to a limited extent in a guide track in the carrier or in a tensioning element.

In particular in the case of such mechanic control devices it is provided that the coupling piece is movable together with the coupling and decoupling element relative to the carrier during at least a part of the opening movement until reaching the predetermined opening path, and upon reaching the predetermined opening path on the one hand the coupling and decoupling element is fixed relative to the carrier and on the other hand the coupling piece is movable relative to the coupling and decoupling element. For this purpose, it is further provided that the coupling and decoupling element comprises an abutment, by means of which the coupling and decoupling element abuts on the carrier, preferably on a head portion of the carrier, upon reaching the predetermined opening path. Thus, the coupling and decoupling and its abutment together with the counter abutment on the carrier form the path-depending control device.

A latch or a similar element can by moved by the coupling and decoupling element in such a way that the coupling piece is no longer fixedly held in the coupling counter piece. For a good engagement it is preferably provided that at least one head region of the coupling piece can be spread by the coupling and decoupling element. This is concretely carried out in that in the case of a spread head region of the coupling piece there is the coupling position between the coupling piece and the coupling counter piece because of a positive-locking engagement between the head region of the coupling piece and a receiving region of the coupling counter piece, whereas in the case of a non-spread head region of the coupling piece there is the decoupling position between the coupling piece and the coupling counter piece because of a loose connection between the head region of the coupling piece and the receiving region of the coupling counter piece.

For this purpose, the head region of the coupling piece is preferably formed in such a way that it comprises two projections distanced from each other and bendable to each other. For the spreading a tip of the coupling and decoupling element is moved into a gap between the projections so that these projections can no longer be moved to each other. As a consequence, a decoupling of the head region from a receiving region of the coupling counter piece is not possible. Only when the tip of the coupling and decoupling element is no longer located between the projections, the projections can be bend in the event of a relative movement of the receiving region to the head region and the loose connection is released.

In order to not only enable a coupling between the ejection device and the movable furniture part but also an ejection, an ejection element for ejecting the movable furniture part from the closed position into an open position and an ejection force storage member force-actuating the ejection element in opening direction of the movable furniture part are preferably provided.

Further, a locking device for locking the ejection element in a locking position is provided, wherein the locking device can be unlocked by over-pressing the movable furniture part into an over-pressing position located behind the closed position In addition, the ejection devices comprises a tensioning device for tensioning the ejection force storage member, preferably by pulling the movable furniture part into opening direction. In this case, the coupling piece of the coupling device is connected to the tensioning device, preferably to a tensioning element of the tensioning device. For a material-saving design it is provided particularly preferred that the coupling piece is formed in one piece with this tensioning element of the tensioning device In order to prevent an unfavorable projection of the individual components from the furniture carcass after the ejection, a retrieving device with a retrieving force storage member for moving the tensioning device into a retrieved position is provided.

Protection is also sought for an item of furniture with a furniture carcass, a movable furniture part and an ejection device for the movable furniture part according to the invention. In this case, the ejection device can be arranged either on the furniture carcass or on the movable furniture part. It is also possible that a, preferably damped, retraction device for retracting the movable furniture part from an open position into the closed position is provided. In the case of such an item of furniture it is provided that the ejection device is coupled to the movable furniture part by the coupling device situated in the coupling position, whereas in the decoupling position the movable furniture part is released from the coupling device.

Figure 2:
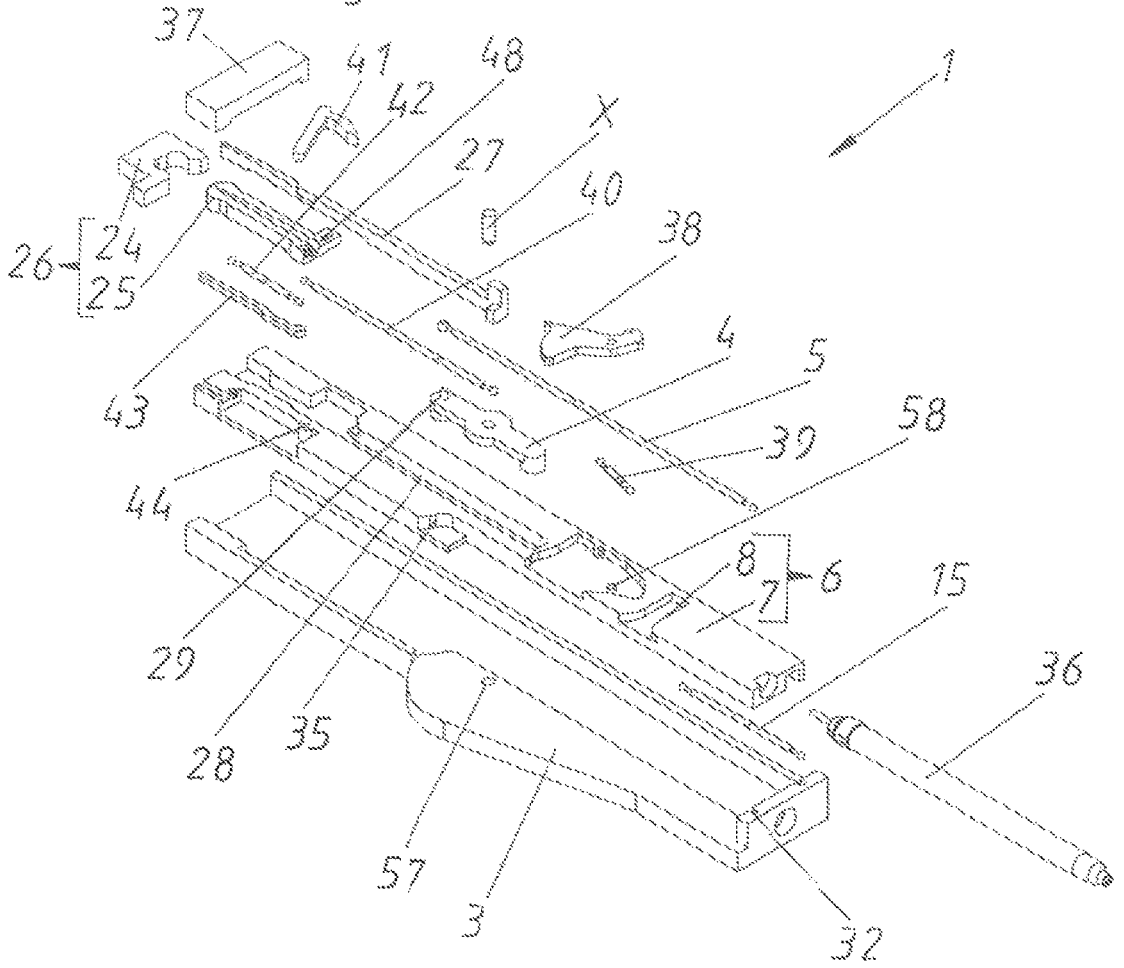
Figure 3:
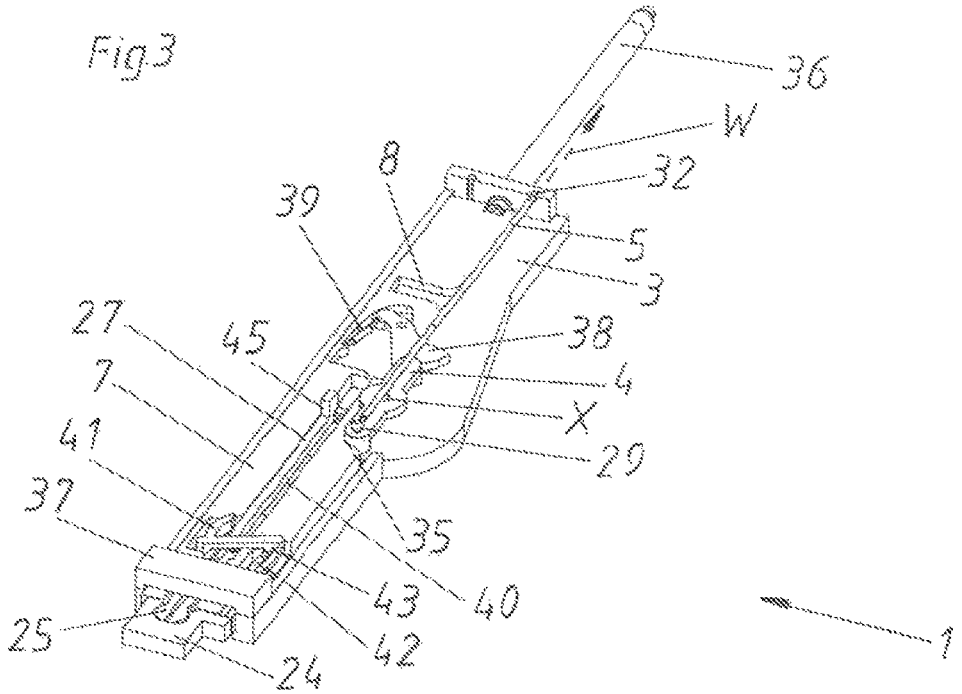
Figure 20:
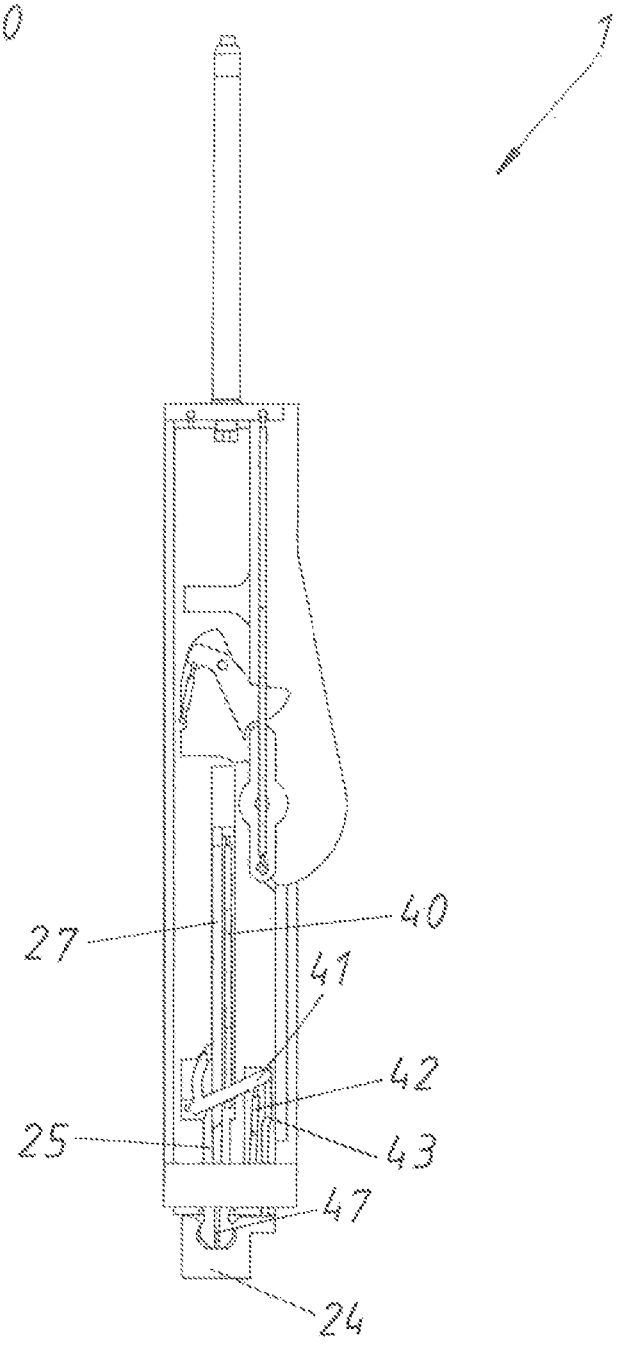
Figure 21:
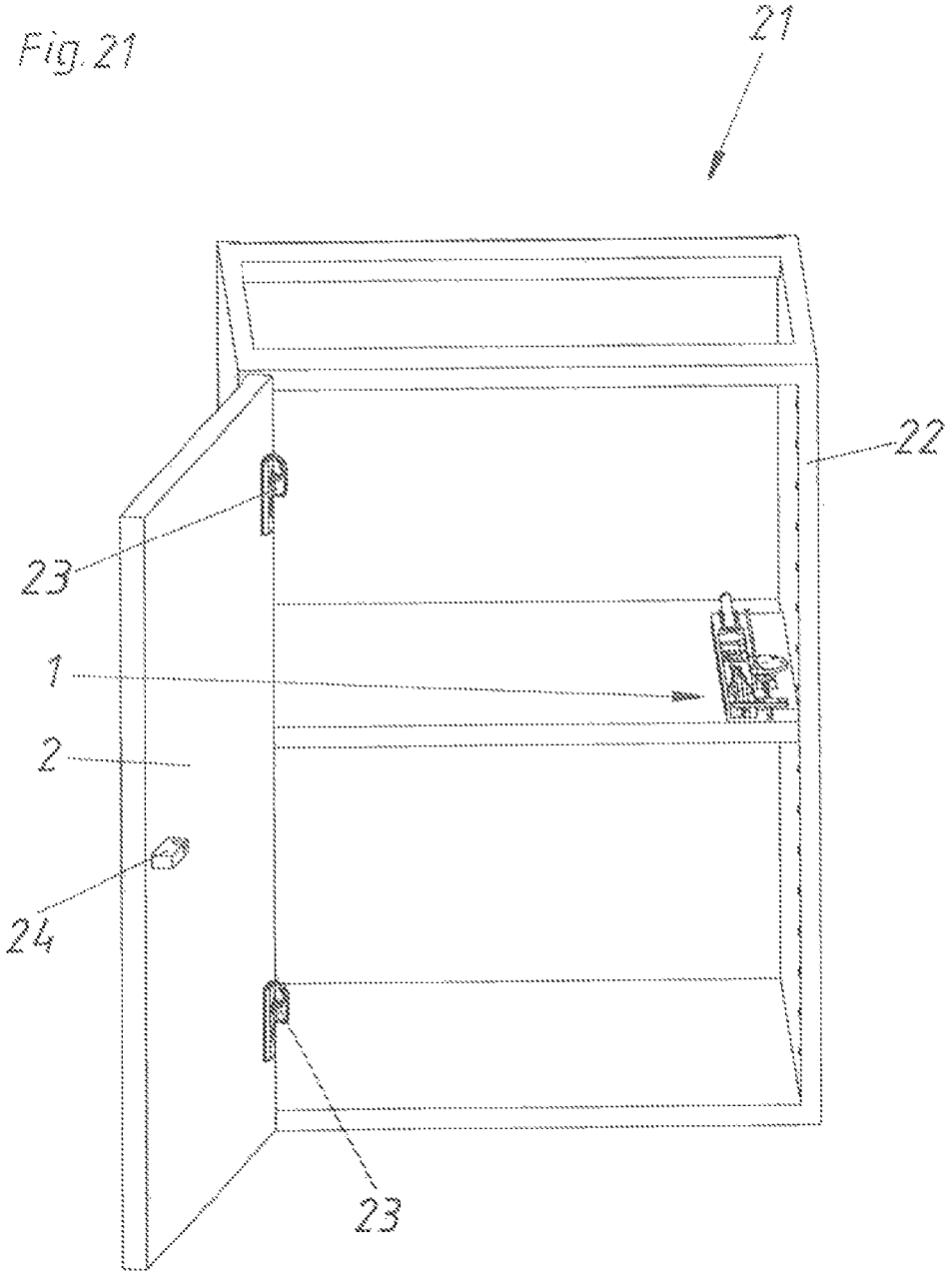
Figure 22:
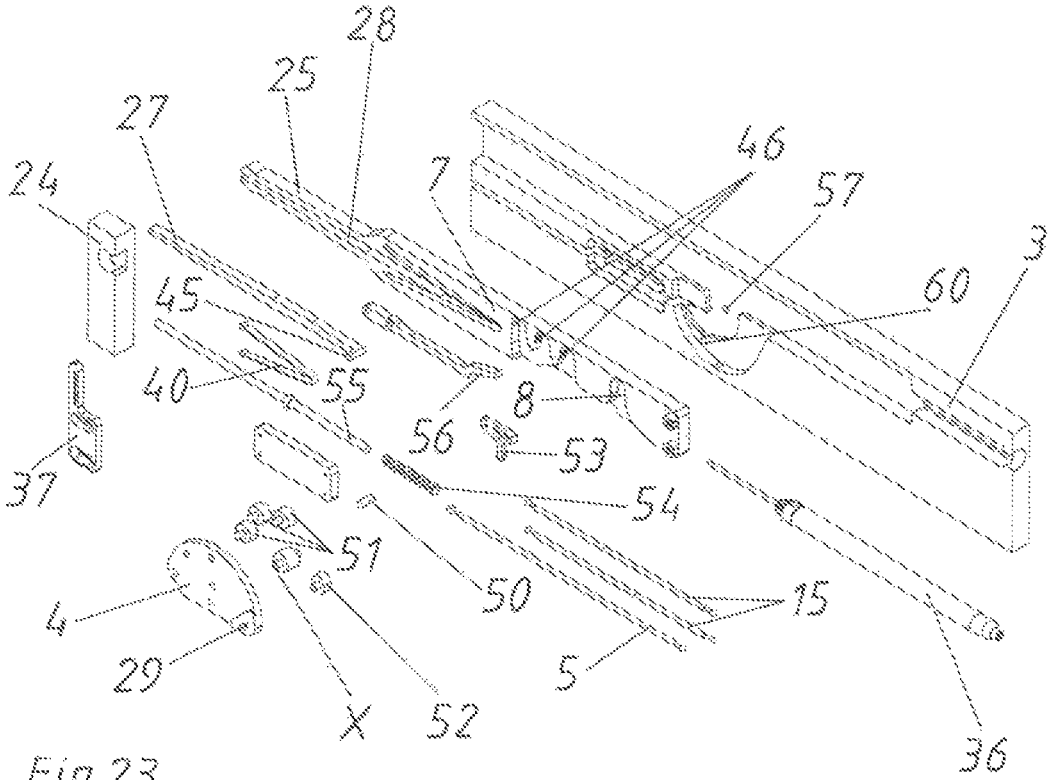
Figure 23:
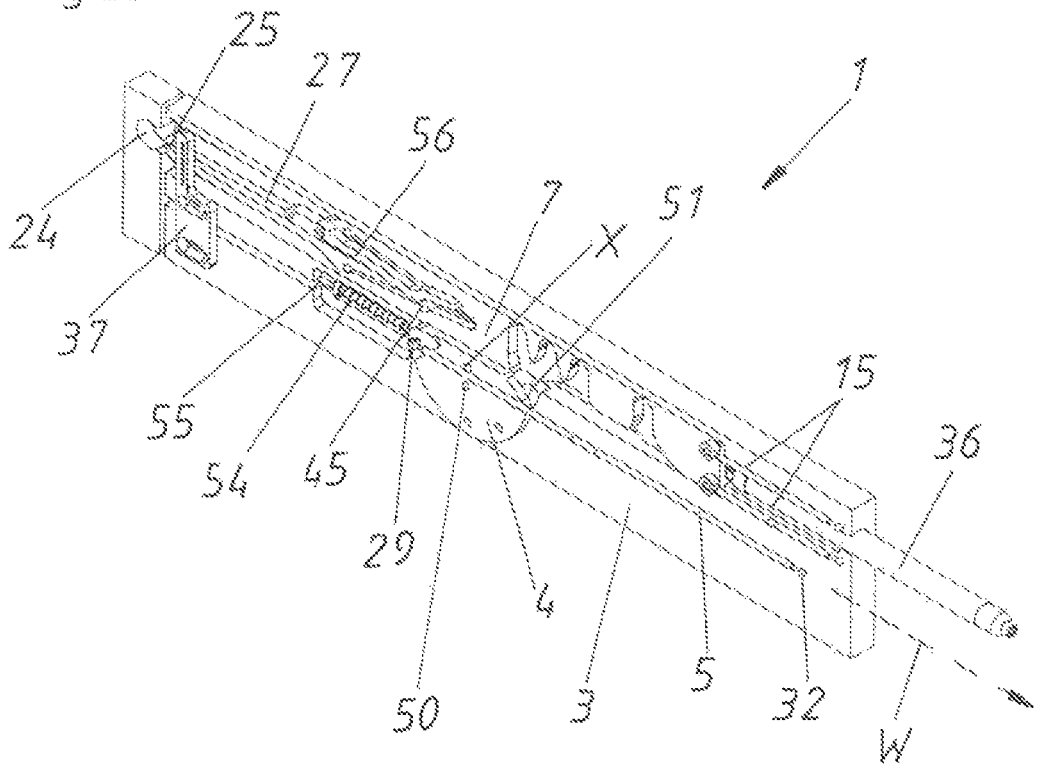
Figure 37:
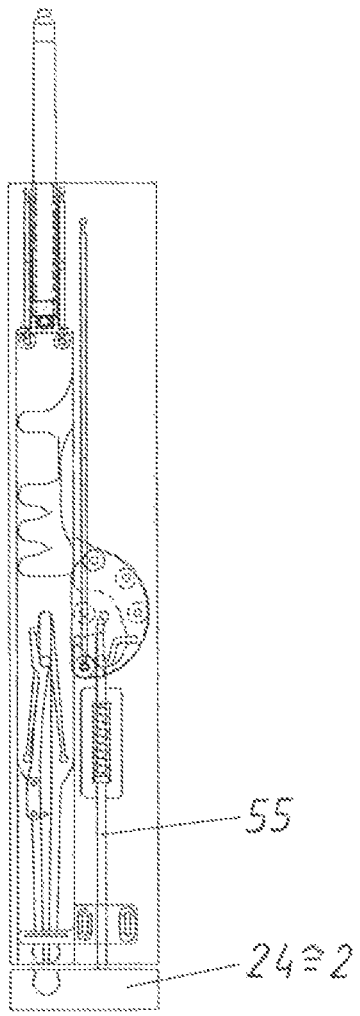
Figure 37:
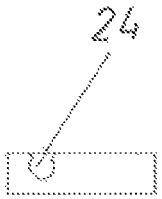
Figure 38:
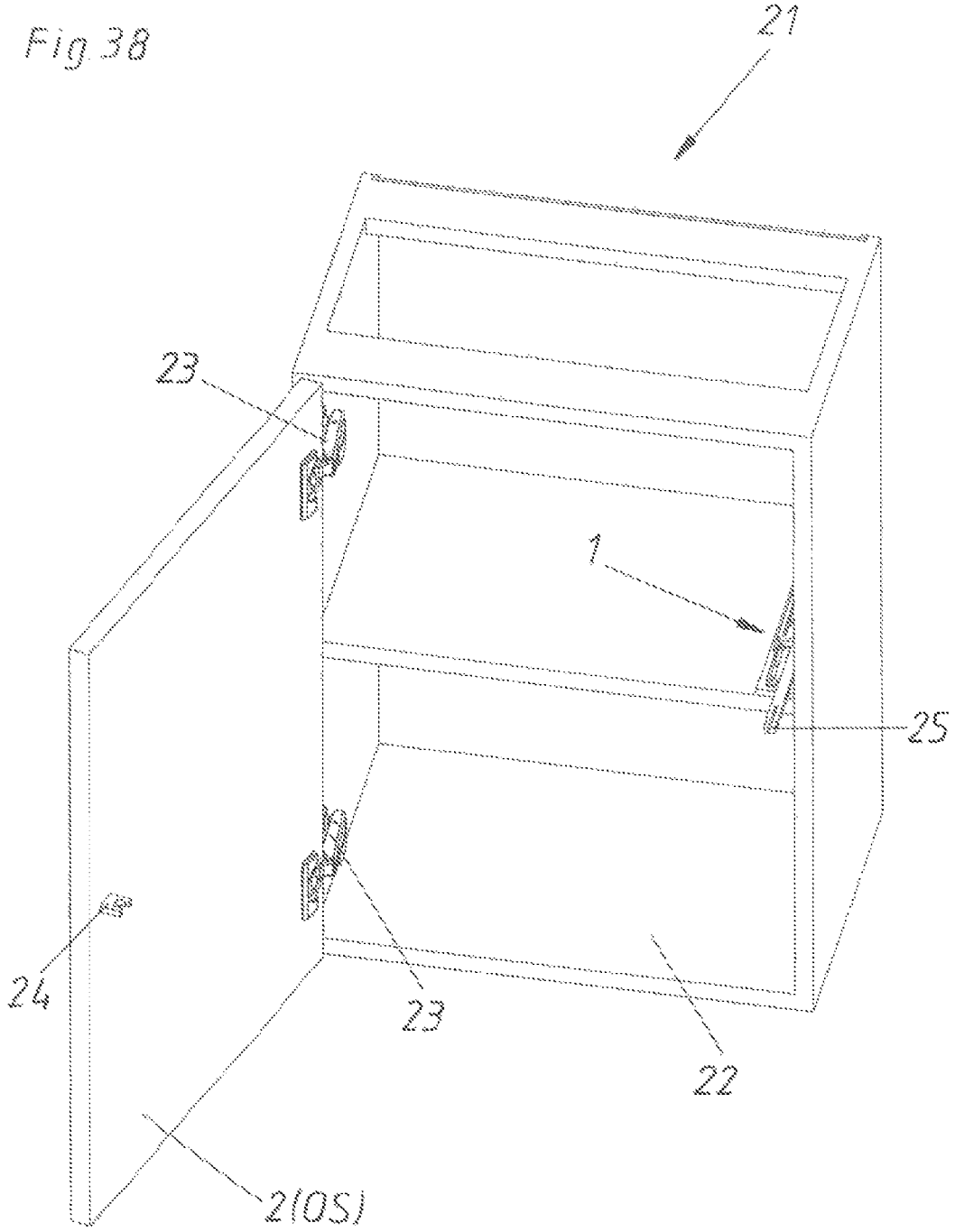
Figure 39:
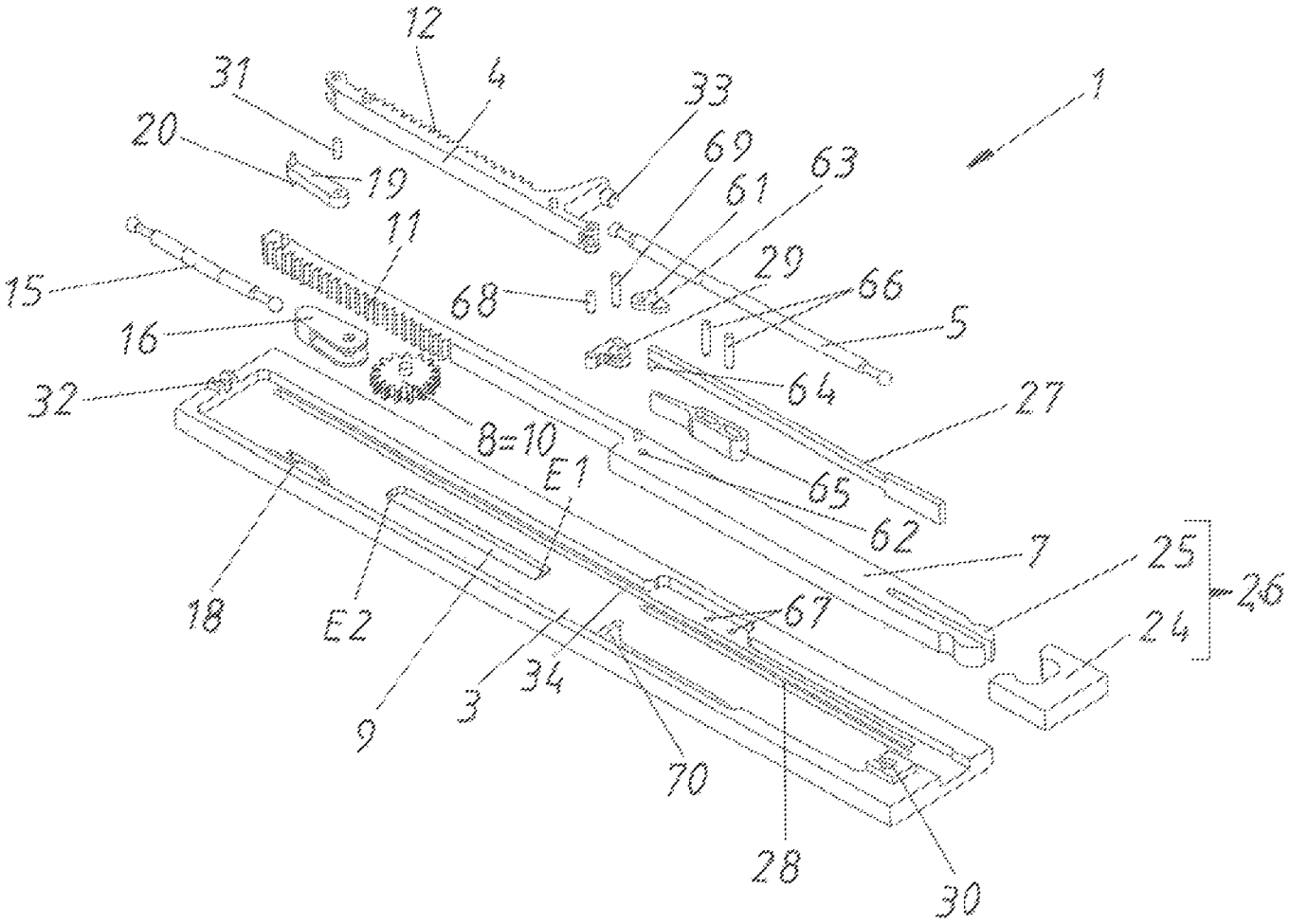
Figure 40:
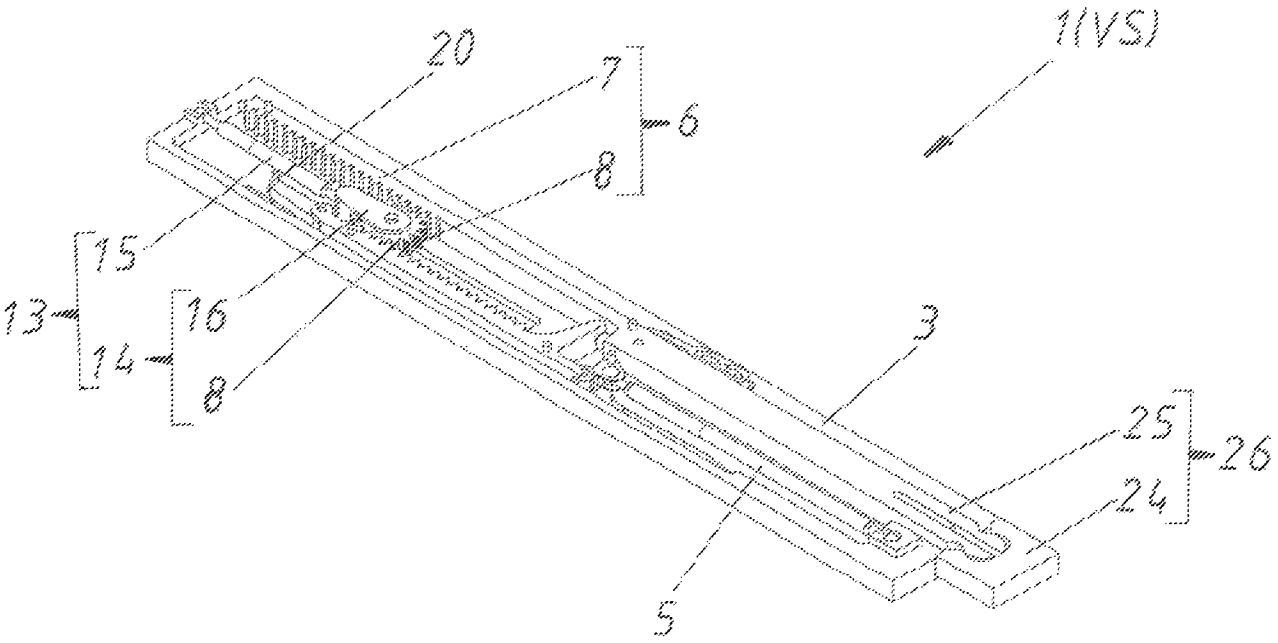
Figure 48:
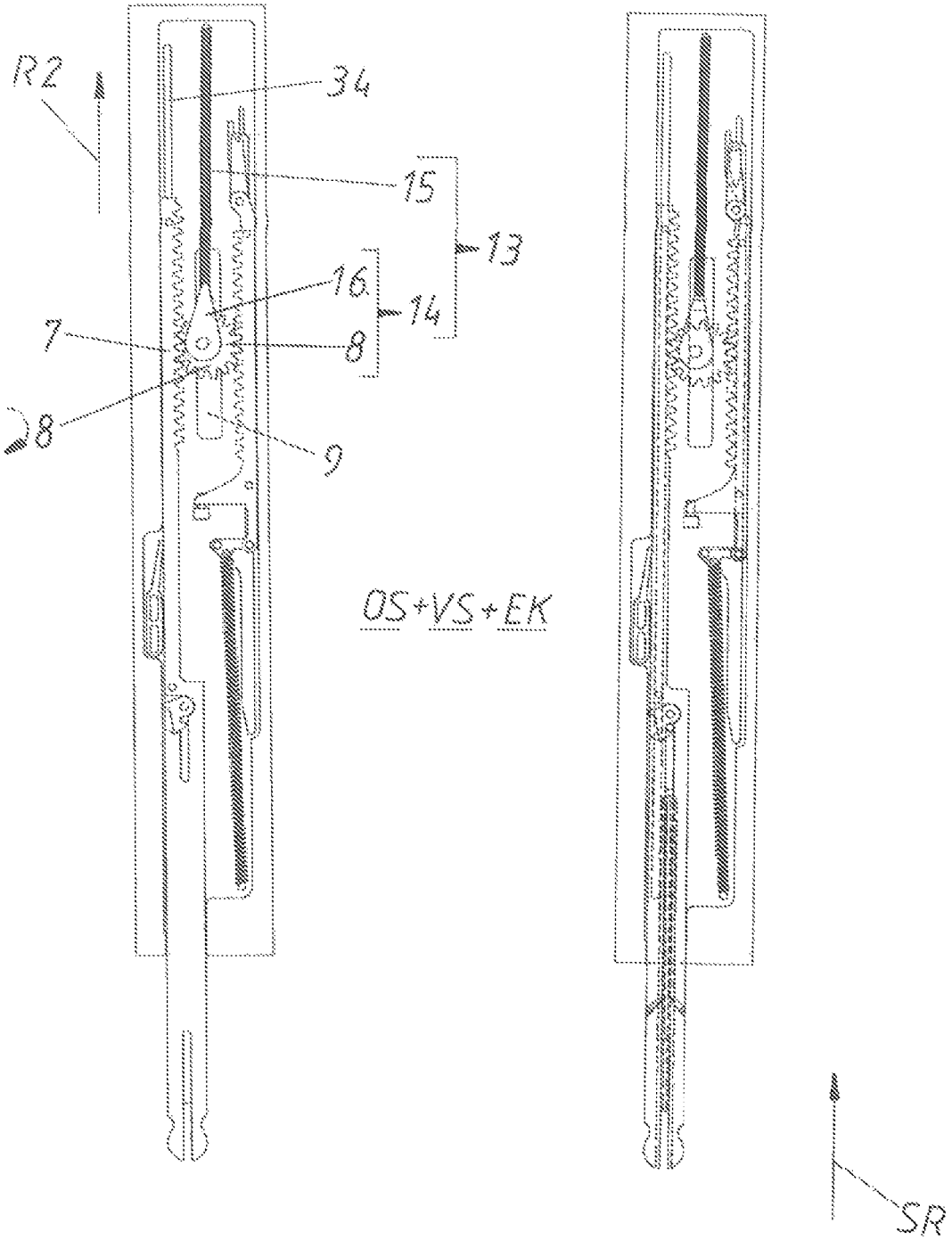
Figure 49:
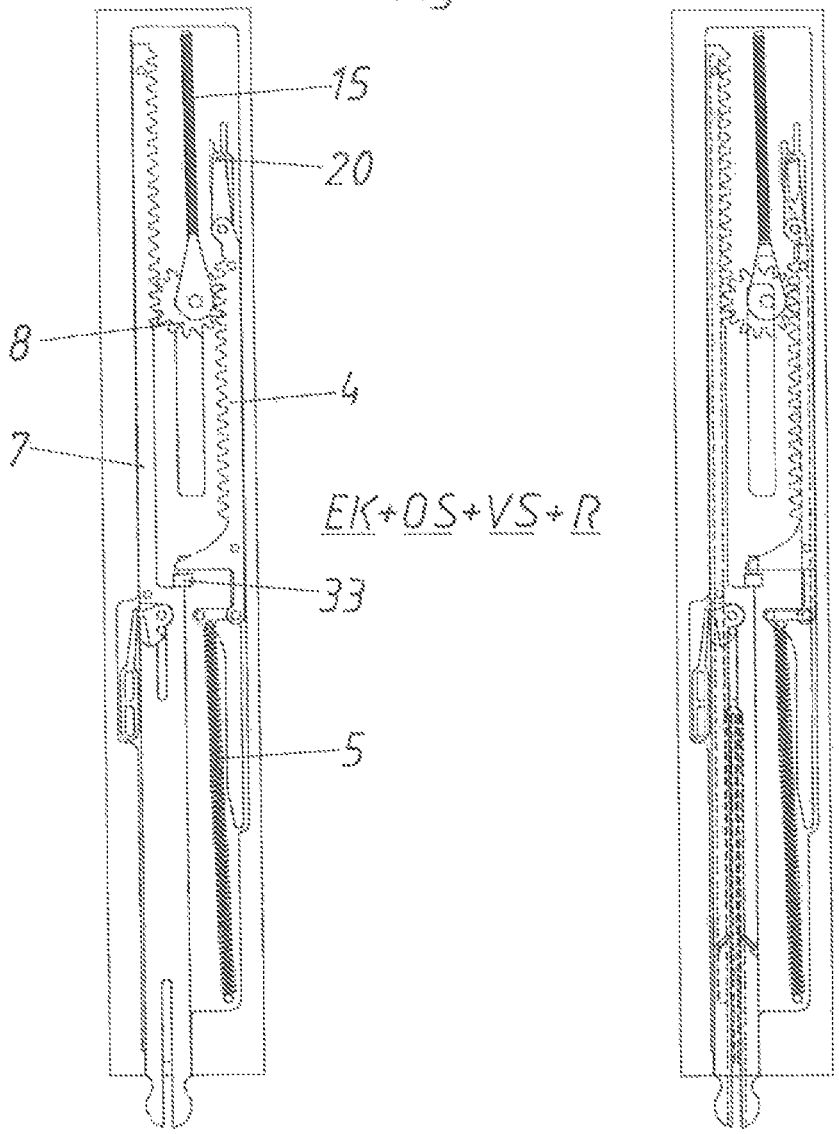
Figure 50:
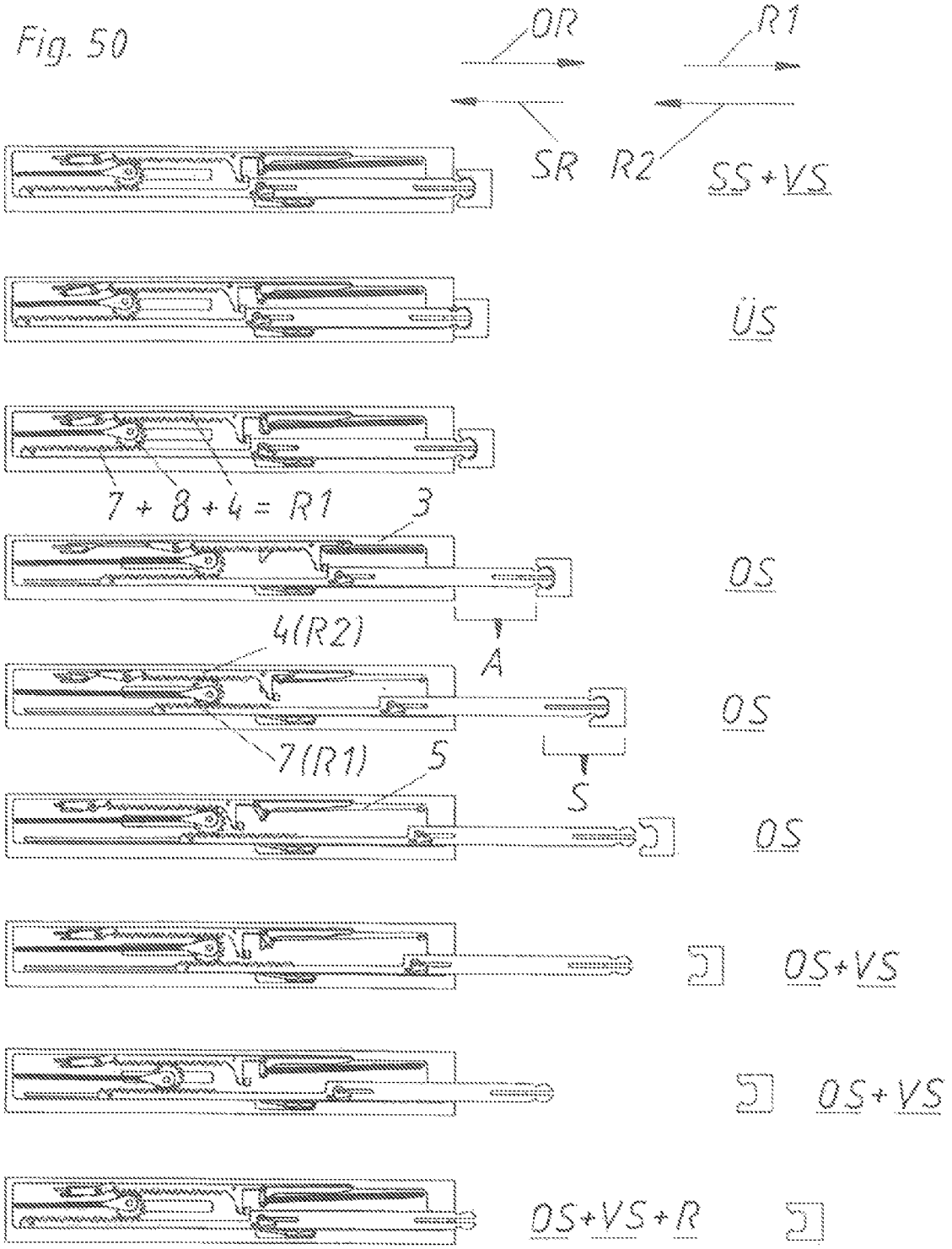
Figure 51A:
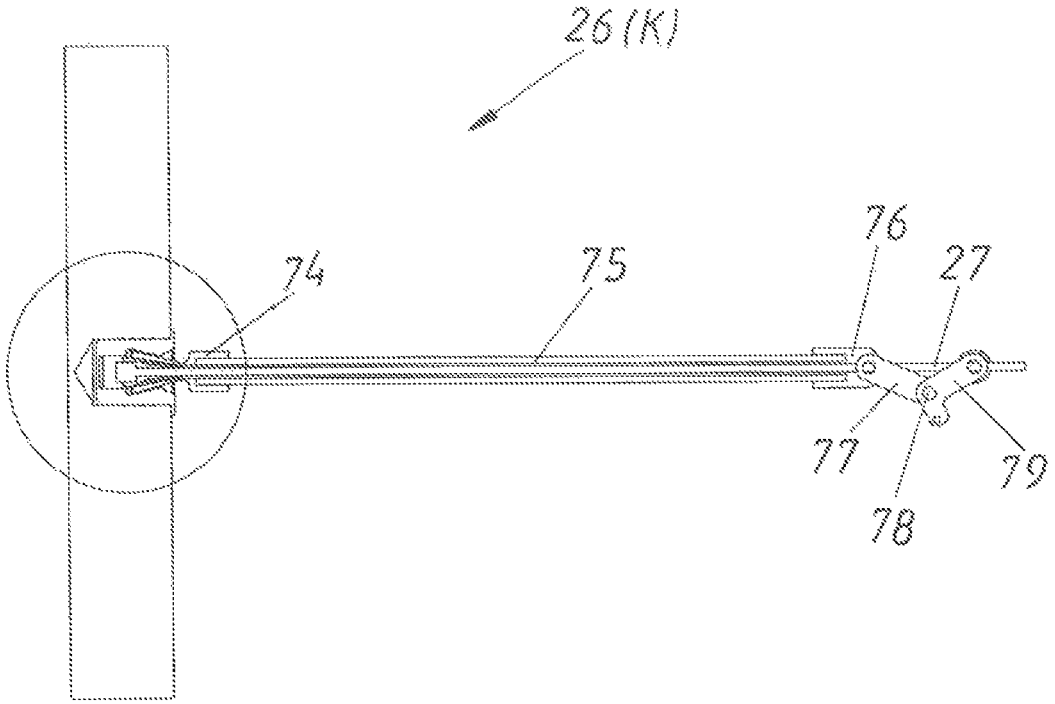
Figure 51B:
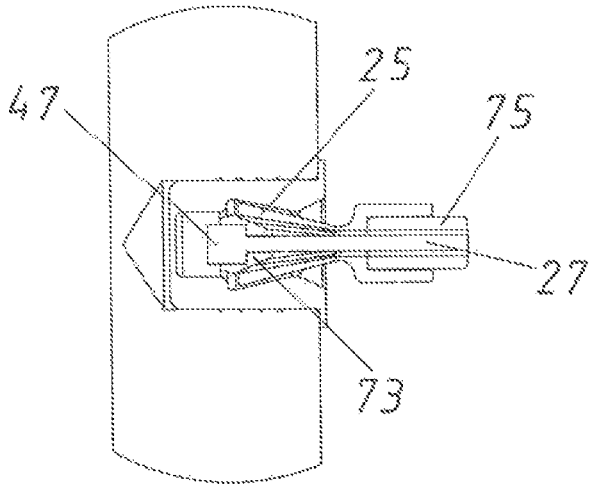
Figure 52A:
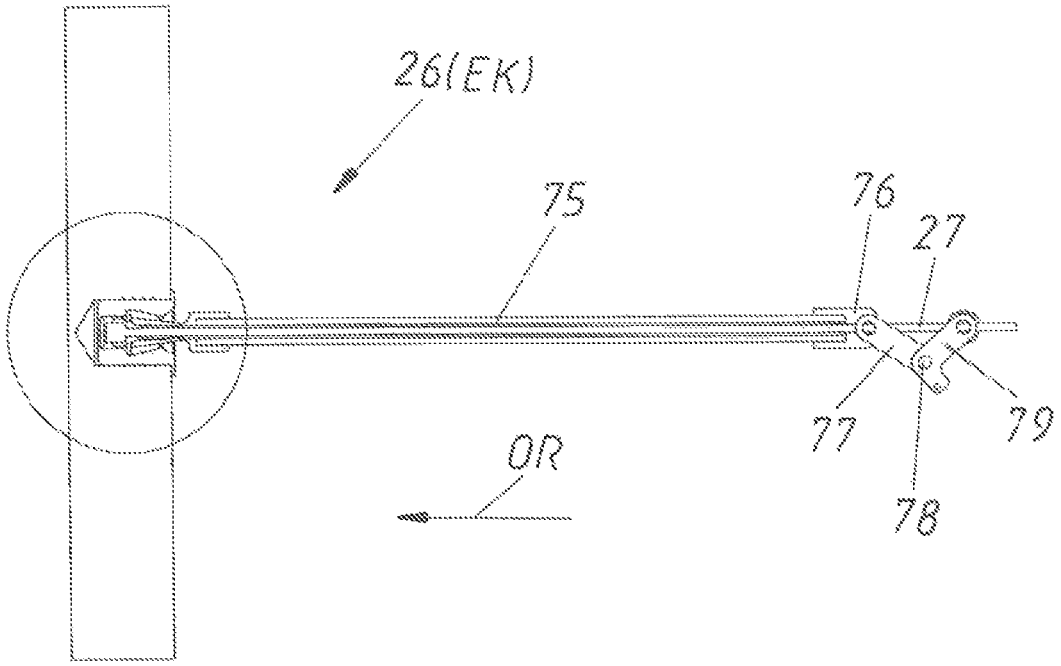
Figure 52B:
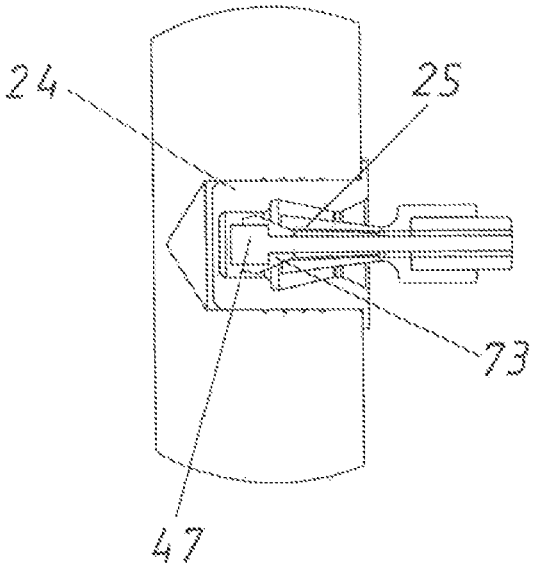
Figure 53A:
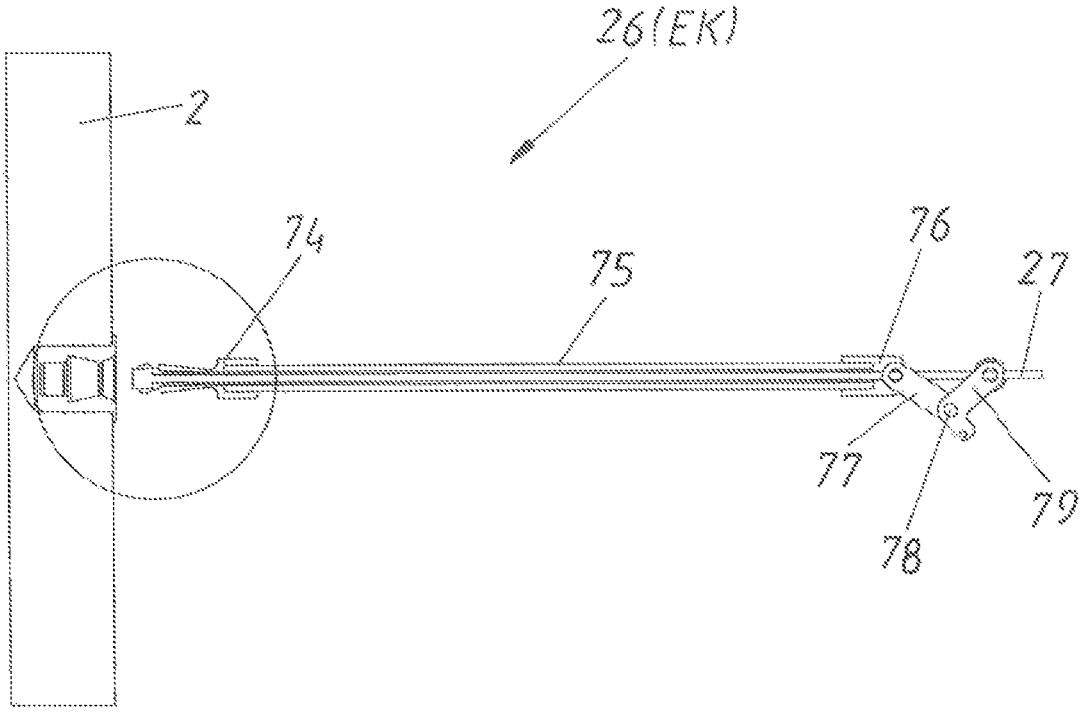
Figure 53B:
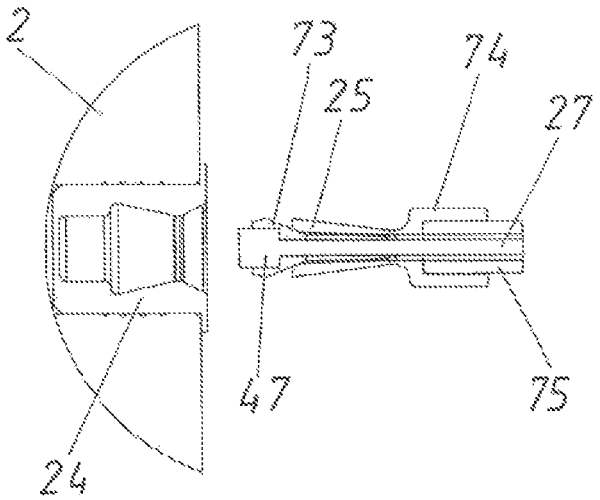

Further details and advantages of the present invention are described more fully hereinafter by means of the specific description with reference to the embodiments illustrated in the drawings, in which:

FIG. 1 shows an item of furniture with an ejection device according to a first embodiment, FIG. 2 shows an exploded view of the ejection device according to the first embodiment, FIG. 3 shows this ejection device in an assembled state, FIGS. 4 to 20 show the movement sequence during the ejection and tensioning of the ejection device according to the first embodiment, FIG. 21 shows an item of furniture with an ejection device according to a second embodiment, FIG. 22 shows an explodes view of the ejection device according to the second embodiment, FIG. 23 shows the ejection device in an assembled state, FIGS. 24 to 37 show the movement sequence of the ejection device according to the second embodiment, FIG. 38 shows a perspective view of an item of furniture with an ejection device according to a third embodiment, FIG. 39 shows this ejection device in an exploded view, FIG. 40 shows a perspective view of the assembled ejection device, FIGS. 41 to 49 show in a top view the movement sequence of the ejection device according to the third embodiment during the ejection, tensioning and retrieving, FIG. 50 shows in an overview the movement sequence of the ejection device on one side, FIGS. 51*a* and 51*b* show a fourth embodiment of a coupling device in the coupling position, FIGS. 52*a* and 52*b* show this coupling device in the decoupling position and loose connection and FIGS. 53*a* and 53*b* show the coupling device according to the fourth embodiment in the decoupling position and with distanced furniture part.

FIG. 1 shows an item of furniture 21 with a furniture carcass 22 and a movable furniture part 2 in form of a furniture door. This movable furniture part 2 is pivotally supported by two hinges 23 on the furniture carcass 22 about a vertical axis. A damping device (not shown) for a closing movement can be integrated in at least one of the hinges 23. An ejection device 1 according to a first embodiment is arranged on the furniture carcass 22. The coupling counter piece 24 of this ejection device 1 is fixed to the movable furniture part 2. Only for the purpose of illustration this coupling counter piece 24 is also directly drawn in the area of the ejection device 1. Of course only the coupling counter piece 24 on the movable furniture part 2 is actually present. Basically, it is possible with all embodiments that the ejection device 1 is arranged on the movable furniture part and the coupling counter piece 24 is arranged or formed on the furniture carcass 22. As a consequence, the ejection device 1 so to speak pushes itself from the furniture carcass 22.

In FIG. 2 the ejection device 1 according to the first embodiment is shown in an exploded view. This ejection device 1 comprises a carrier 3 as a base element by way of which the ejection device 1 is mounted to the item of furniture 21. This carrier 3 together with a cover (not shown) can form a housing for the remaining components of the ejection device 1. The tensioning element 7 is displacably supported in the carrier 3. The displacing movement of this tensioning element 7 is being damped by the damping device 36. The retrieving force storage member 15 on the one hand engages the tensioning element 7 and on the other hand the carrier 3. The tensioning element 7 together with the movement transmission element 8 formed as an abutment are forming the tensioning device 6. Further, an ejection element 4 is rotatably supported about the rotary axis X in the rotary bearing 57 of the carrier 3. The ejection force storage member 5 formed as a tension spring on the one hand engages the ejection element 4 via the ejection element force storage member base 29 and on the other hand engages the carrier force storage base 32 of the carrier 3. The deflection element 38 is pivotally supported on the tensioning element 7 via the rotary bearing pin 58. A deflection force storage member 39 formed as a tension spring is additionally provided between the deflection element 38 and the tensioning element 7. Further, a coupling device 26 is provided. This coupling device 26 is mainly formed by the coupling piece 25 and the coupling counter piece 24. The coupling piece 25 is displacably supported in the guide track 28 of the tensioning element 7. Also the coupling and decoupling element 27 is displacably arranged in this guide track 28. Moreover, a coupling lever 41 is provided which is rotatably supported in the rotary bearing 44 of the tensioning element 7 and which on the one hand is guided in the elongated hole of the coupling piece 25 and on the other hand is hingedly connected to an end of the coupling counter piece abutment 43. Further, a coupling force storage member 40 formed as a tension spring is provided which on the one hand engages the coupling and decoupling element 27 and on the other hand engages the coupling piece 25. Moreover, a coupling lever force storage member 42 also formed as a tension spring is provided. This coupling lever force storage member 42 on the one hand engages the coupling lever 41 and on the other hand engages the tensioning element 7. Further, a head portion 37 is provided which can be connected to the carrier 3.

FIG. 3 shows the ejection device 1 according to the first embodiment in an assembled state. Already in this illustration according to FIG. 3 it can be recognized well that the carrier force storage member base 32 and the ejection element force storage member base 29 are located in a plane comprising the rotary axis X of the ejection element 4 and the line of action W. Further, also the abutment 45 formed on the coupling and decoupling element 27 is visible. It can also be recognized in this FIG. 3 that the ejection element 4 abuts the triggering device 35 formed as an abutment on the tensioning element 7.

Figure 4:
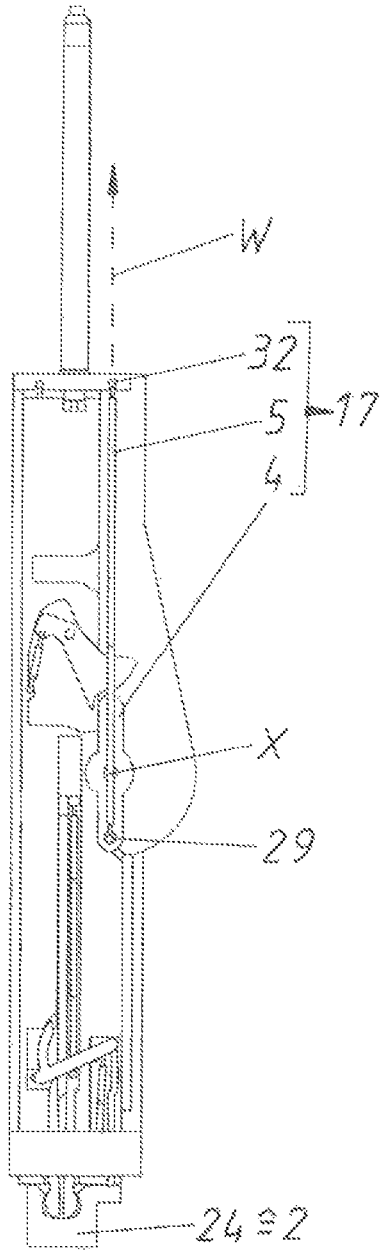

FIG. 4 shows a top view of the ejection device 1 according to FIG. 3. The coupling counter piece 24 attached to the movable furniture part 2 represents the position of the movable furniture part 2. Accordingly, the movable furniture part is located in a closed position SS. The locking device 17 is situated in the locking position VS in which the line of action W of the ejection force storage member 5 is running through the rotary axis X. The direction of action of the line of action W is indicated by the arrow and points in closing direction SR. As this line of action W leads through the rotary axis X, the force of the tensioned ejection force storage member 5 cannot unfold. Therefore, the ejection element 4 is held so to speak in a dead center. The carrier force storage member base 32 (together with the carrier 3), the ejection force storage member 5 and the ejection element 4, thus, together form the locking device 17. The coupling device 26 is situated in the coupling position K as the coupling piece 25 is coupled to the coupling counter piece 24.

Figure 5:
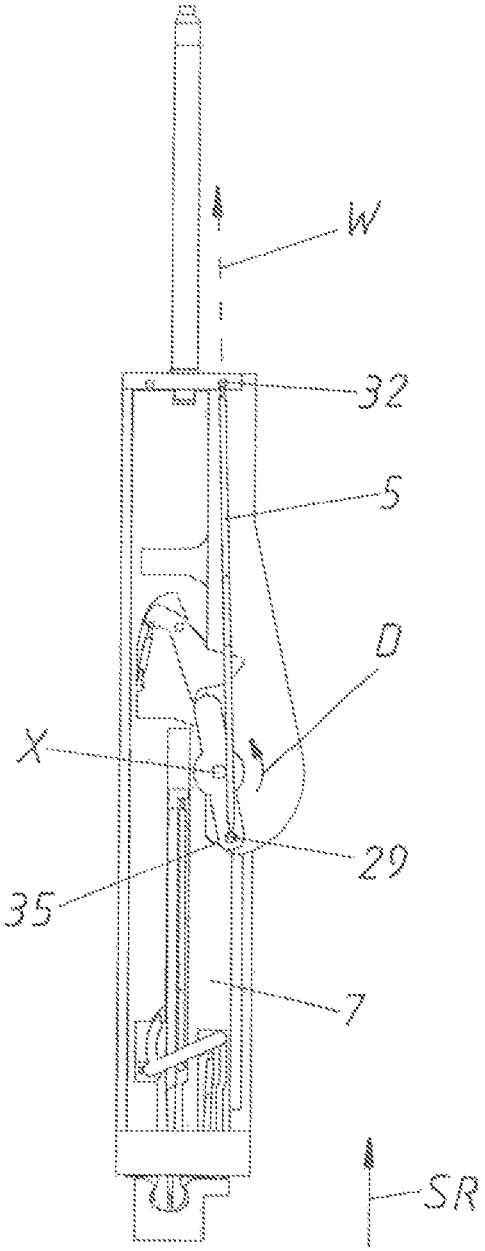

When the movable furniture part 2 is being pressed in closing direction SR starting from this position according to FIG. 4, this movable furniture part 2 reaches the over-pressing position US according to FIG. 5. As a consequence, the tensioning element 7 is also moved in closing direction SR by means of the coupling counter piece 24, whereby the abutment of the triggering device 35 rotates the ejection element 4 in the rotary direction D—thus counterclockwise—about the rotary axis X. As a consequence of this over-pressing the rotary axis X and the line of action W, thus, are distanced from each other and reach a relative unlocking state ES. Hence, the locking device 17 is unlocked.

Figure 6:
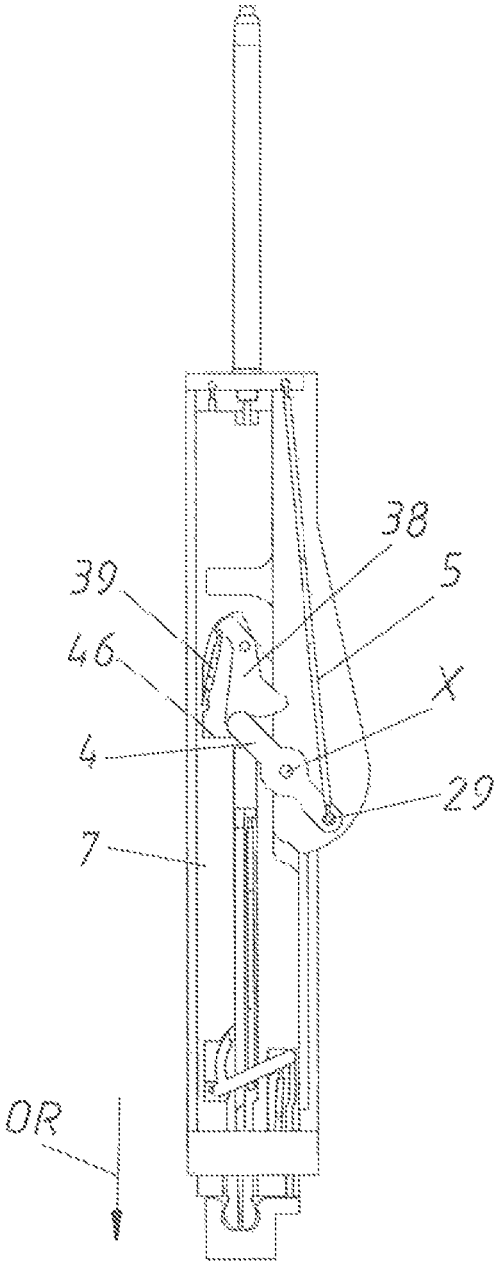

The ejection force storage member 5 can relax starting from this unlocking state ES according to FIG. 5, whereby the ejection element 4 further rotates in rotary direction D (see FIG. 6). As a consequence, the end of the ejection element 4 remote from the ejection element force storage member base 29 reaches contact with the ejection abutment 46 formed on the tensioning element 7. This causes that the whole tensioning element 7 is being moved in the opening direction OR relative to the carrier 3, whereby the movable furniture part 2 in turn reaches an—albeit still marginal—open position OS. At the same time the ejection element 4 also pivots the deflection element 38 clockwise against the force of the deflection force storage member 39.

Figure 7:
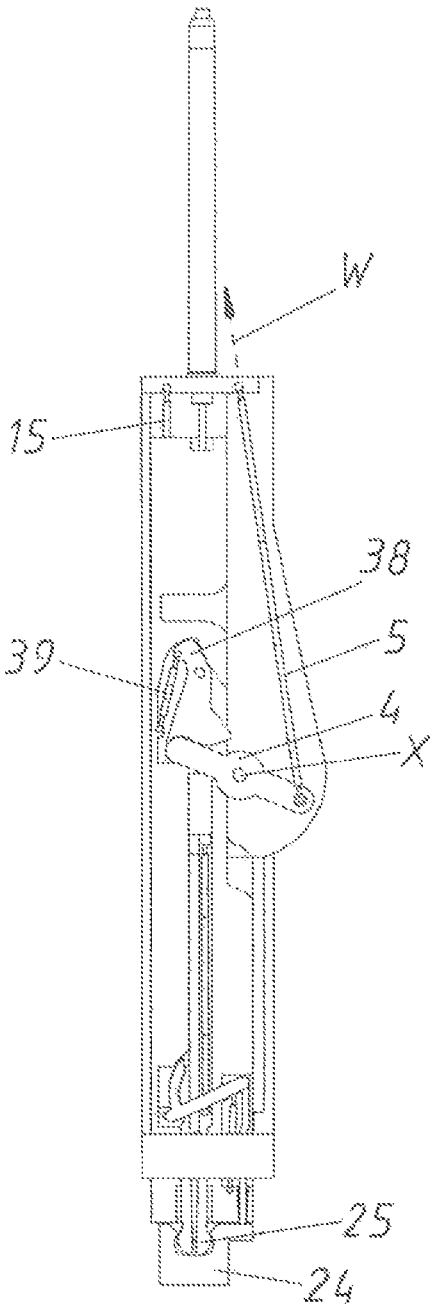

The ejection force storage member 5 has still further relaxed in FIG. 7, whereby the movable furniture part 2 (represented by the coupling counter piece 24) is being moved still further into an open position OS. Thus, the movable furniture part 2 is indirectly being ejected by the ejection element 4 by means of the tensioning element 7 and the coupling piece 25. As the tensioning element 7 is moving in the opening direction OR, also the retrieving force storage member 15 formed as a tension spring starts to tension.

Figure 8:
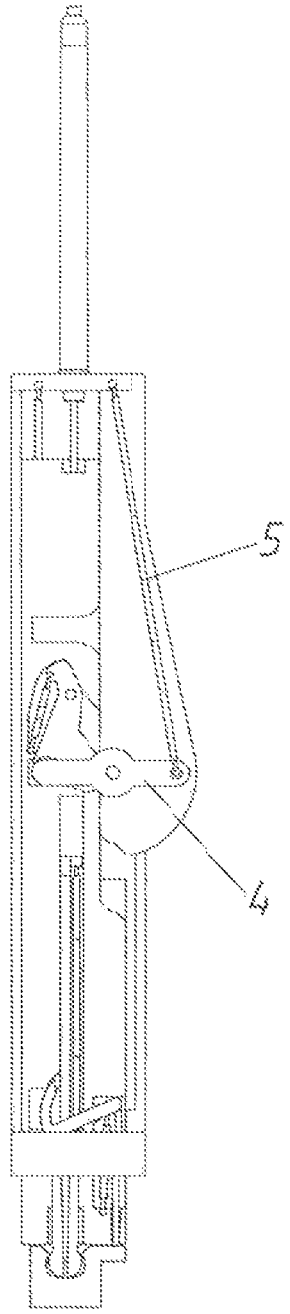

In FIG. 8 a quarter turn of the ejection element 4 is completed. The ejection force storage member 5 has already relaxed substantially halfway. The movable furniture part 2 is located in an open position OS, the locking device 17 is in the unlocking state ES and the coupling device 26 is the coupling position K. The deflection force storage member 39 is fully tensioned.

Figure 9:
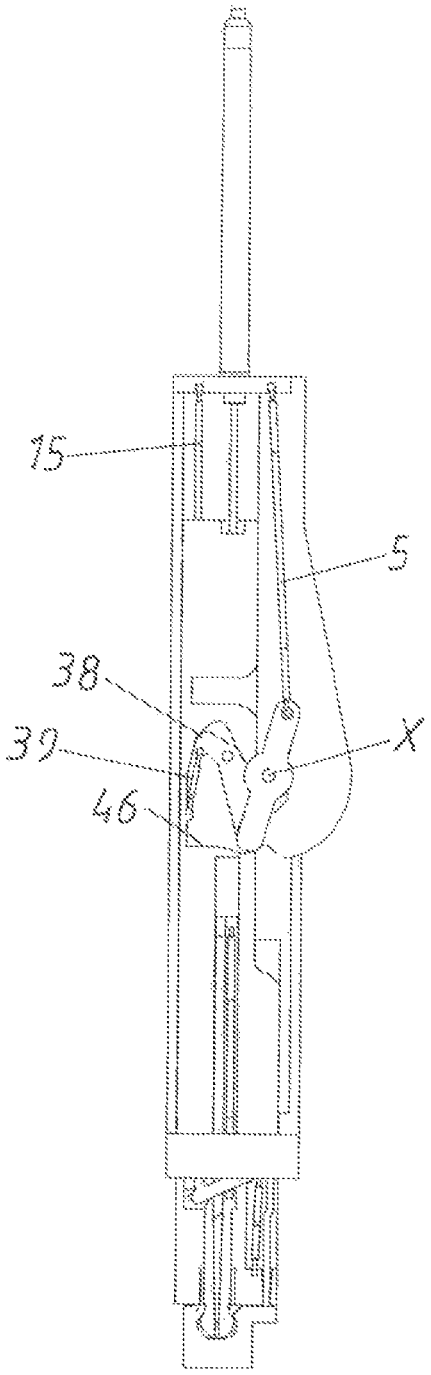

As the ejection element 4 has already moved further according to FIG. 9, also the end of the ejection element 4 remote from the ejection element force storage member base 29 is again being oppositely moved (i. e. in this case to the right). As a consequence, also the deflection force storage member is again being relaxed, whereby the deflection element 38 follows the ejection element 4.

Figure 10:
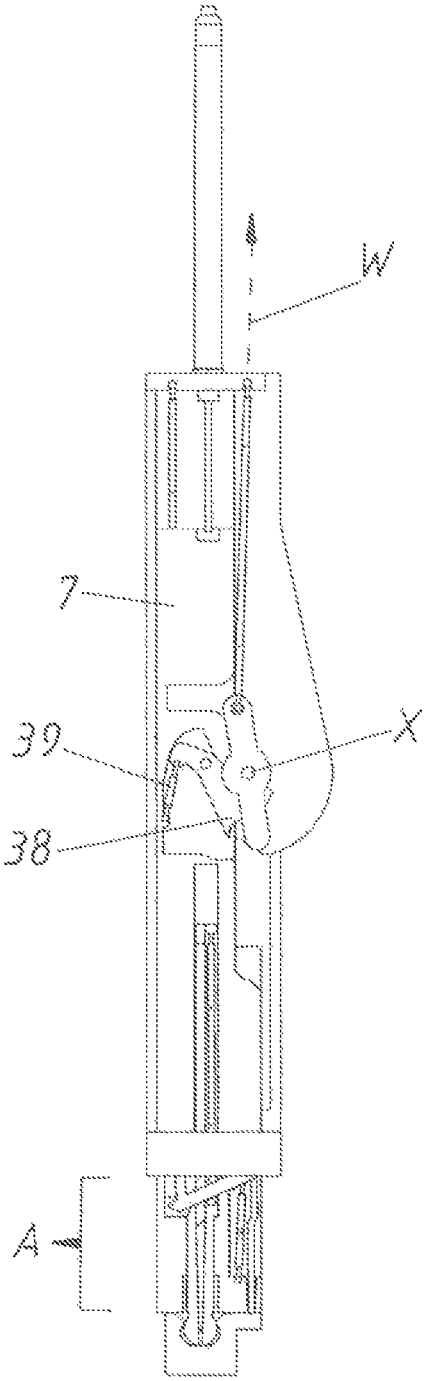
Figure 11:
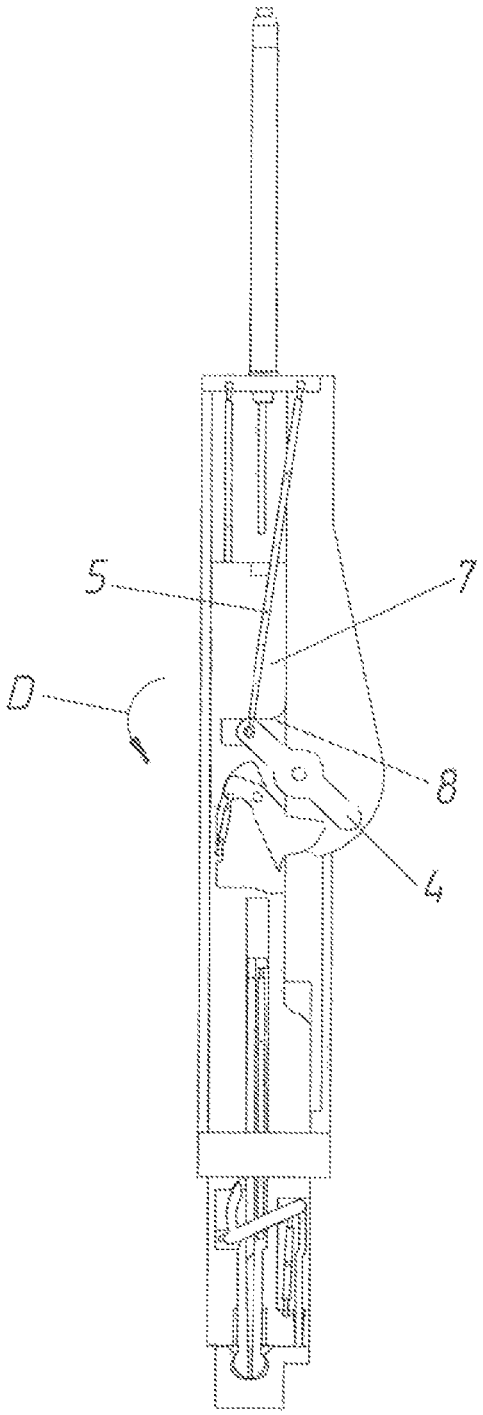

The ejection device 1 reaches a position (not shown) between the FIGS. 9 and 10, in which a dead center opposite from the locking position VS is reached. In this position in a top view the carrier force storage member base 32, the ejection element force storage member base 29 and the rotary axis X are arranged in one line. The deflection force storage member 39, however, is further relaxing in order to still further move the ejection element 4 starting from this neutral state or dead center state, whereby the deflection element 38 moves the ejection element 4 into the position according to FIG. 10. In this position the ejection path A of the ejection device 1 is completed. Starting with this position, thus, the tensioning path S begins, in which the movable furniture part 2 is actively being pulled. As the tensioning element 7 is coupled to the movable furniture part 2 by means of the coupling device 26, according to FIG. 11 also the ejection element 4 is moved in the opening direction OR by means of the movement transmission element 8 formed as an abutment. As a consequence, when tensioning the ejection force storage member 5, the ejection element 4 is rotated in the same rotary direction D (counterclockwise) as when ejecting the movable furniture part 2.

Figure 12:
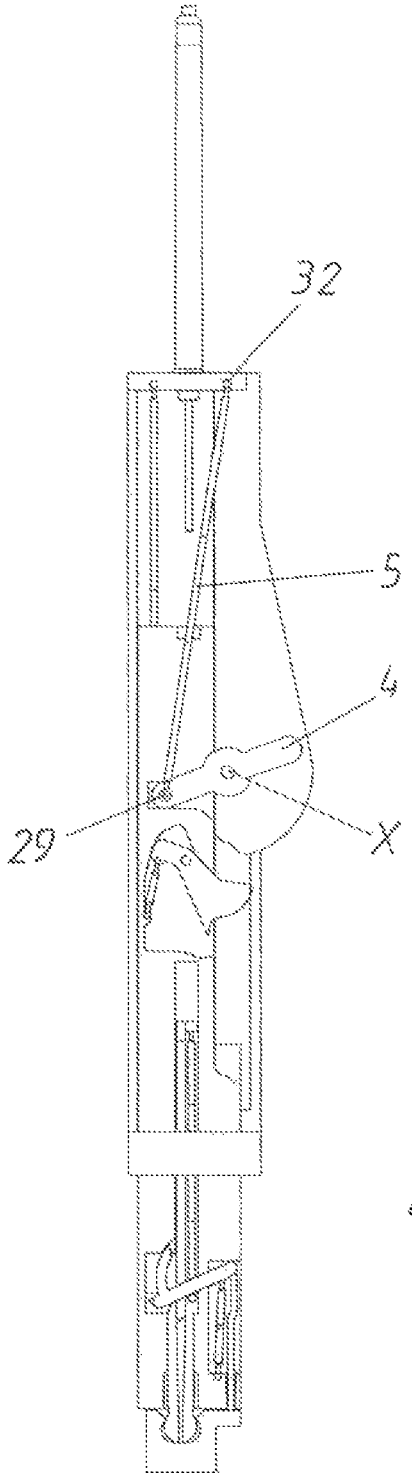

According to FIG. 12 the ejection element 4 has still further rotated in the rotary direction D about the rotary axis X by means of the movement transmission element 8.

Figure 13:
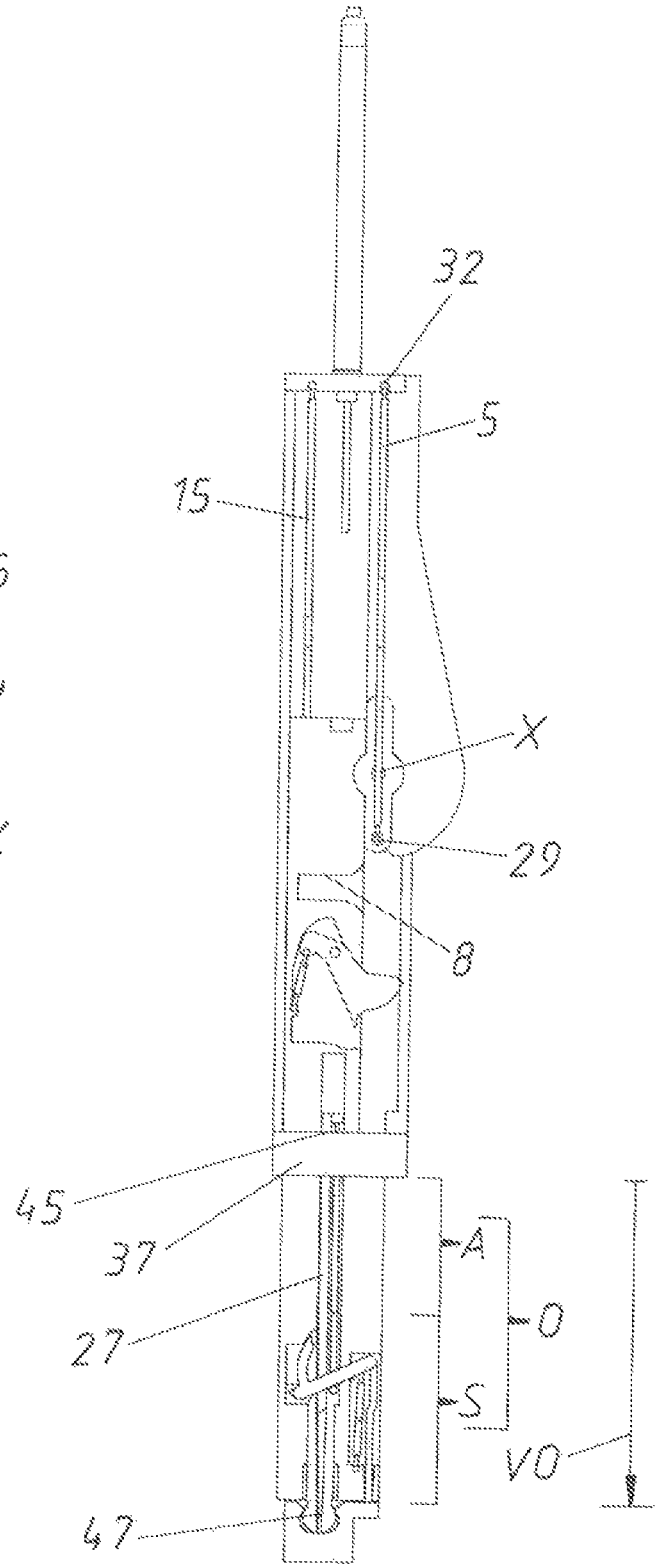

In FIG. 13 the tension path S of the tensioning device 6 is finally completed. Hence, the ejection device 1 has moved along the opening path O (consists of the ejection path A and the tensioning path S) in the opening direction OR. At the same time also the ejection element 4 has carried out a full revolution, whereby the locking position VS is reached again, in which the line of action W of the ejection force storage member 5 is running through the rotary axis 5. The retrieving force storage member 15 is fully loaded. The abutment 45 on the coupling and decoupling element 27 abuts the head portion 37, whereby the predetermined opening path VO for the control device formed by the coupling and decoupling element 27 for the coupling device 26 is reached or travelled. The tip 47 of the coupling and decoupling element 27 is still located in the foremost region of the coupling piece 25, whereby the head region of the coupling piece 25 is still spread or whereby the two projections of the head region, which are distanced from each other by a gap, cannot be bent to each other. The coupling position K between the head region of the coupling piece 25 and the receiving region of the coupling counter piece 24 is provided by a positive-locking engagement.

When further pulling the movable furniture part 2 starting from this position according to FIG. 13, a travel-controlled uncoupling of the coupling device 26 takes place (see FIG. 14). Initially, the tensioning element 7 is further being moved in the opening direction OR by means of the coupling piece 25. As the coupling and decoupling element 27 forming the control device, however, abuts the head portion 37, only the coupling piece 25 together with the tensioning element 7 is moving relative to the carrier 3 in the opening direction OR. As a consequence, the tip 47 of the coupling and decoupling element 27 is removed from the head region of the coupling piece 25, whereby this head region is less strong or no longer spread. Thus, the projections of the head region can bend to each other. Thereby, the decoupling position EK is reached and there is only a loose connection between the head region of the coupling piece 25 and the receiving region of the coupling counter piece 24. Thus, the no longer spread coupling piece 25 can already be released from the coupling counter piece 24 according to FIG. 14. During the relative movement of the coupling and decoupling element 27 to the coupling piece 25 also the coupling force storage member 40 is tensioned as this coupling force storage member 40 on the one hand engages the coupling piece 25 and on the other hand engages the coupling and decoupling element 27.

The movable furniture part 2 is freewheeling as soon as the coupling counter piece 24 is completely released from the coupling piece 25. At the same time, also the coupling force storage member 40 can again relax, whereby the coupling piece 25 is being moved relative to the tensioning element 7 in the closing direction SR. As a consequence, also the coupling lever 41 is being pivoted about the rotary bearing 44. With this movement also the coupling counter piece abutment 43 is being moved beyond the tensioning element 7 while the coupling lever force storage member 42 is relaxing. When the coupling piece 25 is moved back, the head region of the coupling piece 25 arrives between the side walls of the coupling piece guide 49, whereby the parts of the head region of the coupling piece 25 distanced from each other are pressed towards each other. As a consequence, the tip 47 of the coupling and decoupling element 27 cannot move all the way forward into the coupling piece 25. The coupling force storage member 40, thus, cannot be fully tensioned, but only about halfway.

However, in order to still move the coupling piece 25 all the way into the coupling piece guide 49, the coupling lever force storage member 42 relaxes according to FIG. 16 and pivotes the coupling lever 41 till the coupling piece 25 abuts the abutment 59 of the tensioning element 7. As a consequence, also the coupling counter piece abutment 43 is fully extended. The tip 47 of the coupling and decoupling element 27 is not yet completely in the foremost region of the coupling piece 25.

Figure 17:
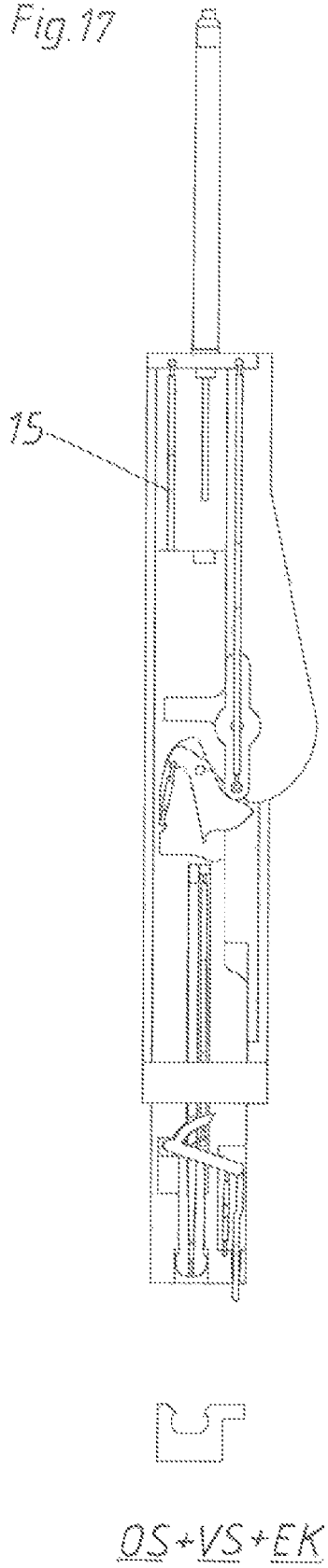

Starting from FIG. 16, respectively already starting from FIG. 15, also the retrieving force storage member 15 begins to relax, whereby the position according to FIG. 17 is initially reached.

Figure 18:
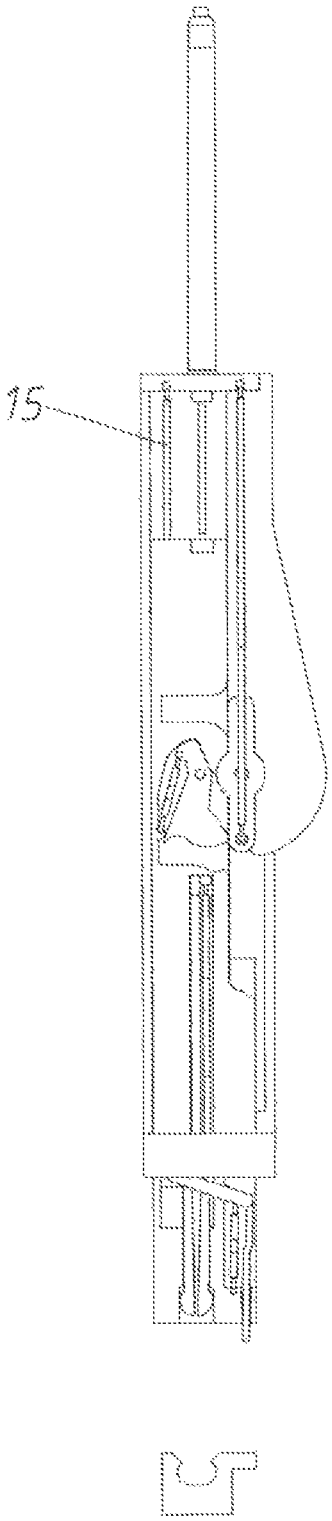
Figure 19:
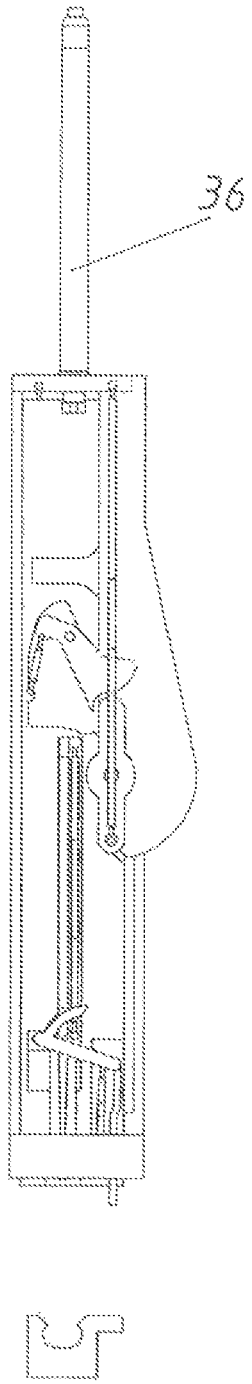

Subsequently, the tensioning element 7 is further moved back until the position according to FIG. 18 by means of the relaxing retrieving force storage member 15. Finally, the retrieved position R in FIG. 19 is reached. This retrieving movement from FIG. 18 to FIG. 19 is damped by the damping device 36. The movable furniture part 2 is still in an open position OS. The locking device 17 is in the locking position VS.

When finally also the movable furniture part 2 is being closed according to FIG. 20, the coupling counter piece 24 initially reaches contact with the coupling counter piece abutment 43. As a consequence, the coupling piece 25 is initially moved in the opening direction OR by the rotary movement of the coupling lever 41, whereby the initially non-spread head region of the coupling piece 25 engages the receiving region of the coupling counter piece 24. As then the coupling piece 25 is no longer held between the side surfaces of the coupling piece guide 49 in a narrowing manner, also the coupling force storage member 40 has relaxed according to FIG. 20, whereby the tip 47 of the coupling and decoupling element 27 has again fully penetrated the head region of the coupling piece 25 and, thus, has spread this head region. Hence, the coupling position K of the coupling device 26 is again reached in FIG. 20. This FIG. 20 corresponds again to the starting position according to FIG. 4.

FIG. 21 shows an item of furniture 21 comprising a furniture carcass 22 and a movable furniture part 2 with a second embodiment of an ejection device 1. Also in this case, the movable furniture part is again hingedly connected to the furniture carcass 22 by means of hinges 23. The coupling counter piece 24 of the ejection device 1 is mounted to the movable furniture part 2.

The second embodiment of the ejection device 1 is shown in detail in the exploded view according to FIG. 22. Again, the ejection device 1 comprises a carrier 3 which forms together with a cover (not shown) a housing for the remaining components of the ejection device. The tensioning element 7 is displaceably supported in the carrier 3. This tensioning element 7 is movably supported on the carrier 3 in a damped manner by means of a damping device 36. The tensioning element 7 is connected to the carrier 3 by means of a retrieving force storage member 15. A guide track 28 for the coupling and decoupling element 27 is provided in the tensioning element 7. This coupling and decoupling element 27 is prestressed to the left against the tensioning element 7 by means of a coupling force storage member 40. In this case, the coupling force storage member 40 is formed as a V-formed tension spring, wherein the tension spring is held with its ends in the tensioning element 7 and abuts the coupling and decoupling element 27 in a central region. Further, a coupling element tensioner 56 connected to the carrier 3 is provided, the coupling element tensioner 56 can abut the abutment 45 of the coupling and decoupling element 27. Moreover, also in the embodiment a head portion 37 is mounted to the carrier 3. In total three ejection abutments 46 are provided in the tensioning element 7, the ejection abutments 46 correspond to the ejection rollers 51 arranged on the ejection element 4. The ejection element 4 itself is rotatably supported in the rotary bearing 57 of the carrier 3 about the rotary axis X. In addition, a tensioning roller 52 is arranged on the ejection element 4. An eccentric pin 50 is eccentrically arranged on the ejection element 4. The ejection force storage member 5 is connected on the one hand to the ejection element 4 by means of the ejection element force storage member base 29 and is connected on the other hand to the carrier 3 by means of the carrier force storage member base 32. Further, also a triggering device 35 is provided. In this embodiment the triggering device 35 is formed by the triggering element 55, the triggering spring 54 and the triggering bracket 53. This triggering bracket 53 is held in the recess 60 of the carrier 3.

In FIG. 23 the second embodiment of the ejection device 1 is shown in an assembled state. Here, the abutment 45 of the coupling and decoupling element 27 abuts the coupling element tensioner 56. Moreover, it can be seen that in the shown locking position VS the carrier force storage member base 32 and the ejection element force storage member base 29 are located in a plane comprising the rotary axis X of the ejection element 4 and the line of action W.

Figure 24:
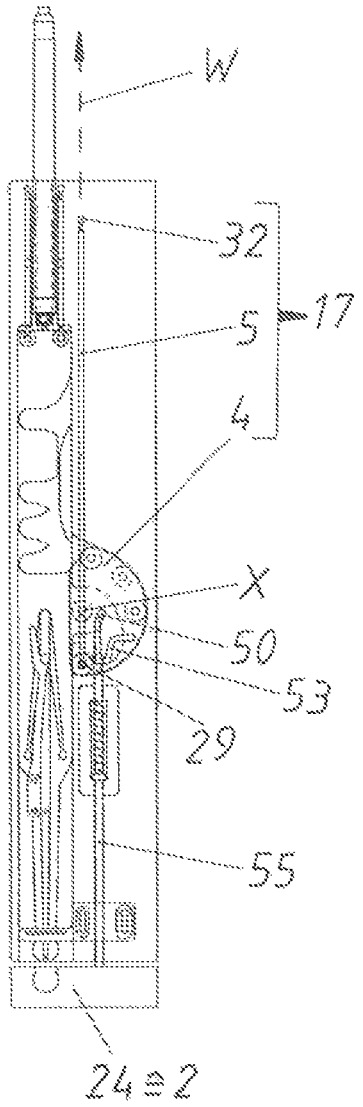

FIG. 24 shows a top view of the ejection device 1 corresponding to FIG. 23. The position of the coupling counter piece 24 corresponds to the position of the movable furniture part 2 which is located in the closed position SS. In addition, the locking device 17 is in the locking position VS as the line of action W of the ejection force storage member 5 is running through the rotary axis X. The triggering bracket 53 abuts with its front side the eccentric pin 50. The knee region of the triggering bracket 53, in turn, abuts the end region of the triggering element 55. The other end of this triggering element 55 abuts the coupling counter piece 24. The head region of the coupling piece 25 is indeed spread by the tip 47 of the coupling and decoupling element 27, as the head region of the coupling piece 25, however, is not located in the receiving region of the coupling counter piece 24, the coupling device 26 is still in a decoupling position EK.

Figure 25:
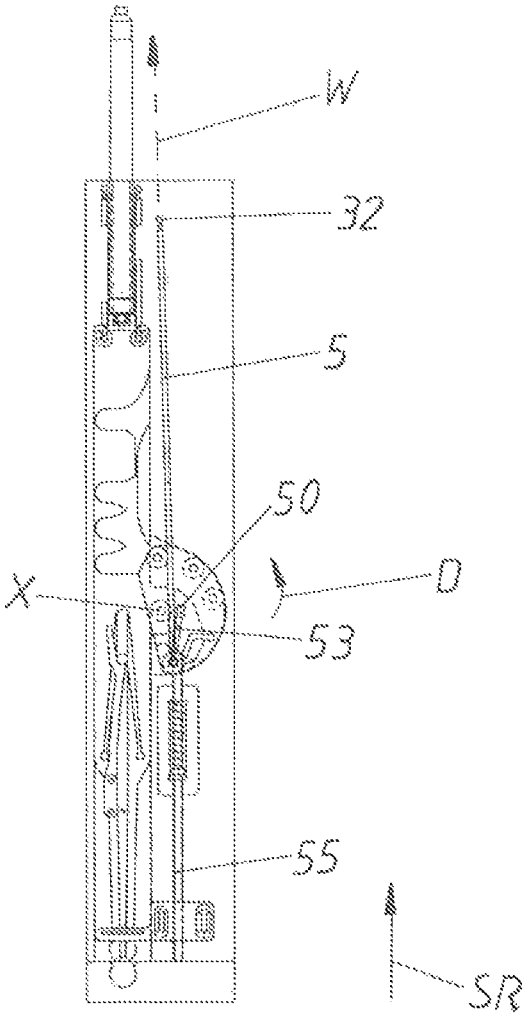

If now pressing in the closing direction SR onto the movable furniture part 2 starting from this closed position SS according to FIG. 24, the movable furniture part 2 arrives in the over-pressing position US according to FIG. 25. As the triggering element 55 abuts the coupling counter piece 24 and as the flexible triggering bracket 53, in turn, abuts the triggering element 55 by means of its knee region, the front side of the triggering bracket 53 is being pressed onto the eccentric pin 50, whereby the ejection element 4 is being rotated in the rotary direction D about the rotary axis X. As a consequence, the rotary axis X and the line of action W arrive in a relative unlocking state ES where the rotary axis X and the line of action W are distanced from each other. Thus, the locking device 17 is unlocked. (In the shown embodiment the ejection element force storage member base 29 is always moved for the unlocking. In principle, however, it would also be possible that, when over-pressing, the rotary axis X is shifted in such a way that the rotary axis X is distanced from the line of action W. Thereby, the line of action W would remain unchanged in relation to the carrier 3, the rotary axis X, however, would move relative to the carrier 3.)

Figure 26:
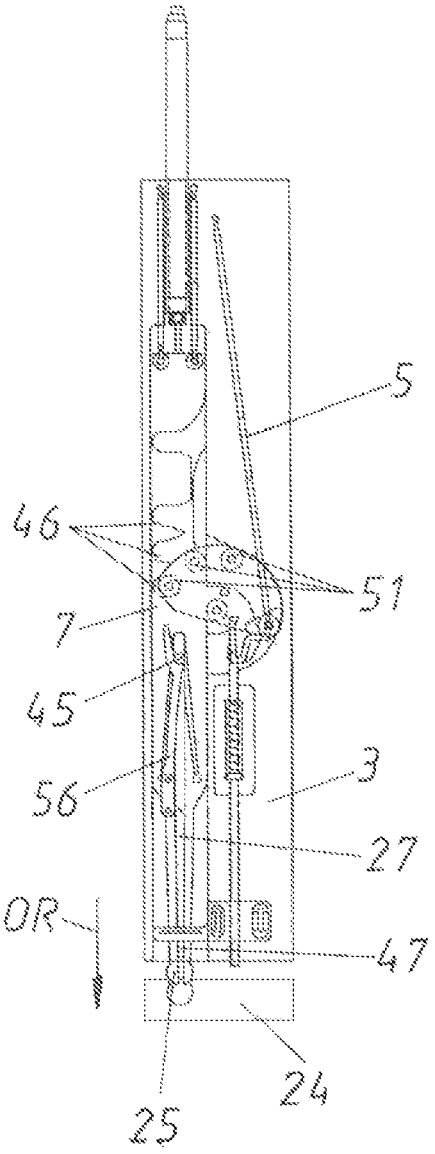

As soon as a user of the item of furniture 21 is no longer pressing onto the movable furniture part 2, the ejection force storage member 5 starts to further relax according to FIG. 26. This ejection force storage member 5 moves the ejection element 4 and rotates the ejection element 4 counterclockwise further in the rotary direction D. As a consequence, the first of the three ejection rollers 51 reaches contact with the first of the three ejection abutments 46, whereby the tensioning element 7 is being moved by the ejection element 4 in the opening direction OR. As the coupling piece 25 is integrally formed with the tensioning element 7, also the coupling counter piece 24 and the movable furniture part 2 (together with the coupling counter piece 24) is being moved in the opening direction OR by means of the head region of the coupling piece 25. Thereby, the movable furniture part 2 is in a—albeit still marginal opened—open position OS. The locking device 17 is in an unlocking state ES. The coupling device 26 is still in a decoupling position EK. According to FIG. 26, the tensioning element 7 has already been slightly moved in the opening direction OR relative to the carrier 3. However, as the coupling element tensioner 56 is attached to the carrier and as the abutment 45 abuts this coupling element tensioner 56, the coupling and decoupling element 27 forming the control device does not move together with the tensioning element 7 in the opening direction OR. As a consequence, the tip 47 of the coupling and decoupling element 27 is removed from the head region of the coupling piece 25. Thus, the head region of the coupling piece 25 is already less spread.

Figure 27:
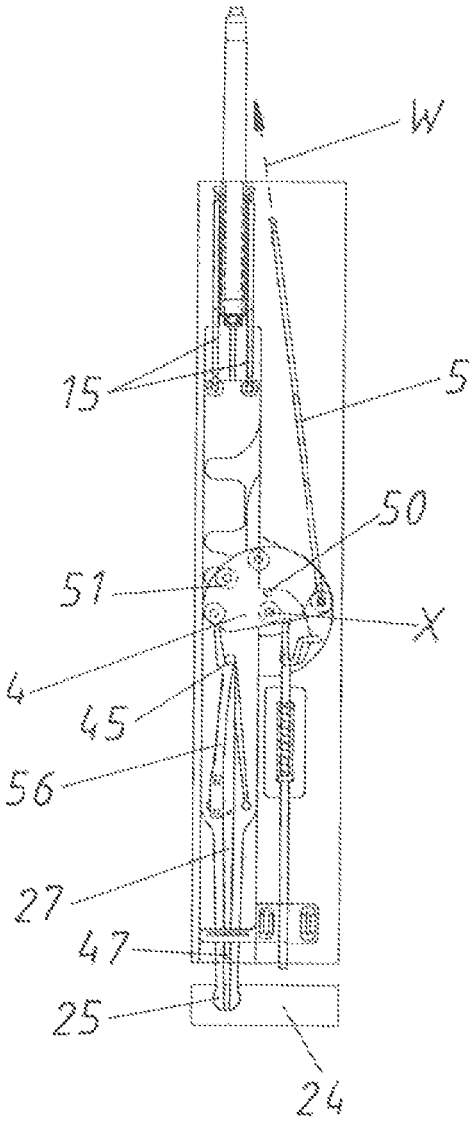

As according to FIG. 27 the tip 47 is still further moved back relative to the coupling piece 25, the head region of the coupling piece 25 is no longer spread and this head region can slide into the receiving region of the coupling counter piece 24 because of the bendable design of its two projections. As a consequence, however, only a loose connection between the coupling piece 25 and coupling counter piece 24 is reached. The coupling force storage member 40 is tensioned according to FIG. 27 by the movement of the coupling and decoupling element 27 along the guide track 28 relative to the tensioning element 7. According to FIG. 27 also the ejection element 4 has already rotated further, whereby a second ejection roller 41 reaches contact with a second ejection abutment 46.

Figure 28:
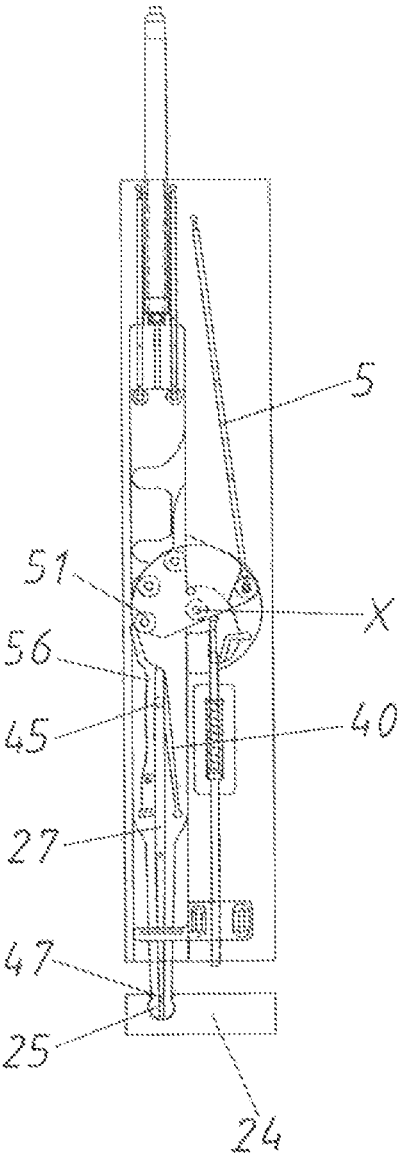

In the case of a further rotation of the ejection element 4 according to FIG. 28, an end of the elastic coupling element tensioner 56 reaches contact with the ejection element 4, whereby the coupling element tensioner 56 is slightly bent to the left. As a consequence, the abutment 45 of the coupling and decoupling element 27 is no longer held by the coupling element tensioner 45, whereby the coupling force storage member 40 can relax. Thereby, also the coupling and decoupling element 27 is again moved relative to the tensioning element 7 in the opening direction OR, whereby the tip 47 of the coupling and decoupling element 27 arrives in the head region of the coupling piece 25 and spreads this coupling piece 25. As a consequence, a safe positive-locking engagement and, thus, the coupling position K between the coupling piece 25 and the coupling counter piece 24 is reached. This coupling position K cannot be released without a movement of the coupling and decoupling element 27 relative to the coupling piece 25.

Figure 29:
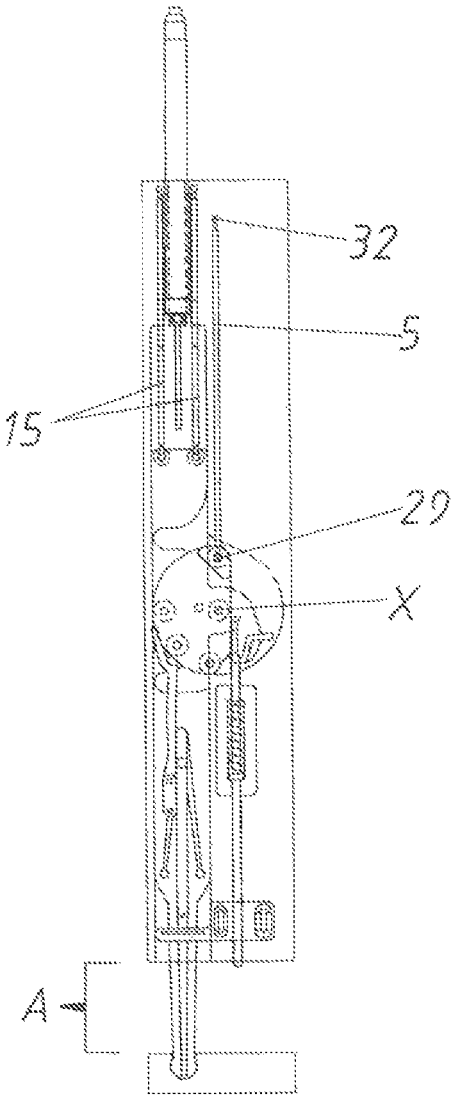

A half turn of the ejection element 4 is finished according to FIG. 29. Hence, the ejection force storage member 5 has completely relaxed and the ejection element 7 is again located in a neutral position. For this reason, the ejection path A of the ejection device 1 is finalized. The retrieving force storage members 15 have already relaxed about halfway. Starting from this FIG. 29 the movable furniture part 2 is now being pulled in the opening direction OR.

Figure 30:
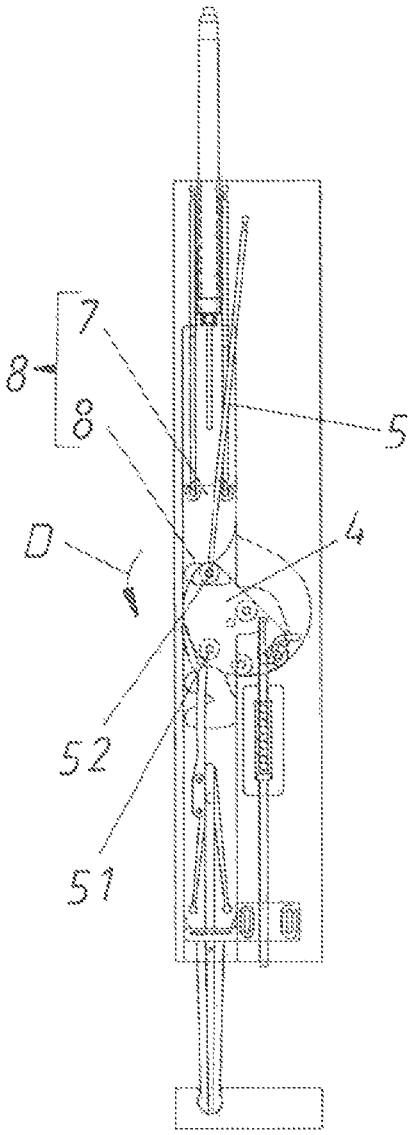

By this further pulling movement, which has already begun in FIG. 30, the tensioning element 7 is being moved further in the opening direction OR relative to the carrier 3. As a third ejection roller 51 is still in contact with the third ejection abutment 46, also the ejection element 4—when tensioning the ejection force storage member 5—is further rotated in the same direction D as when ejecting the movable furniture part 2. At the same time, also the tensioning roller 52 contacts the movement transmission element 8. The tensioning element 7 together with this movement transmission element 8 formed as an abutment are forming the tensioning device 6 for the ejection force storage member 5. This ejection force storage member 5 is already partly tensioned in FIG. 30.

Figure 31:
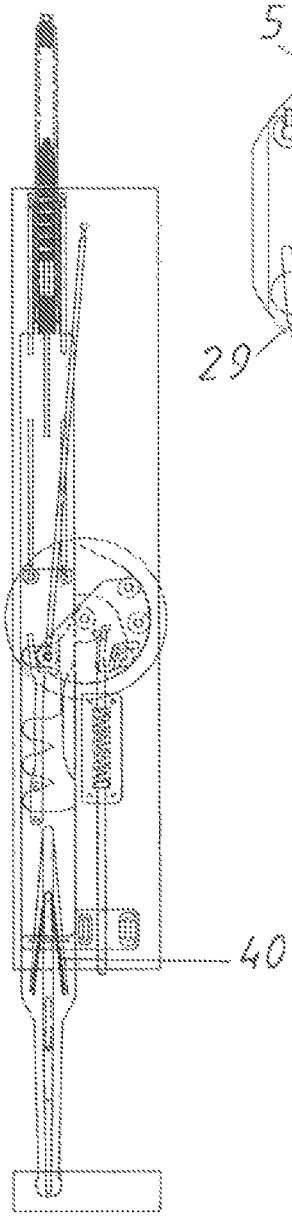
Figure 31:
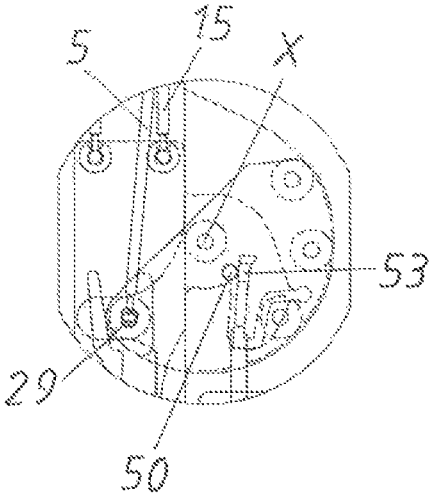

According to FIG. 31 the movable furniture part 2 has still been moved further in the opening direction OR and at the same time the ejection element 4 has been rotated further in the rotary direction D, whereby the eccentric pin 50 abuts a flank of the triggering bracket 53 and bends this triggering bracket 53 already slightly to the right because of its flexibility. This can be seen well in the detail shown top right.

Figure 32:
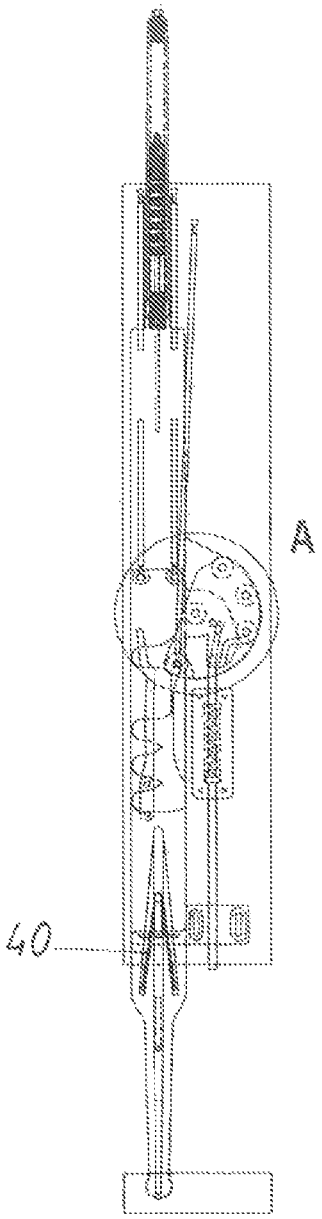

In FIG. 32 the movable furniture part 2 has still been moved further in the opening direction OR, whereby the ejection element 4 has rotated further. As a consequence, the eccentric pin 50 bends the triggering bracket 53 in a still more significant manner (see detail top right).

Figure 33:
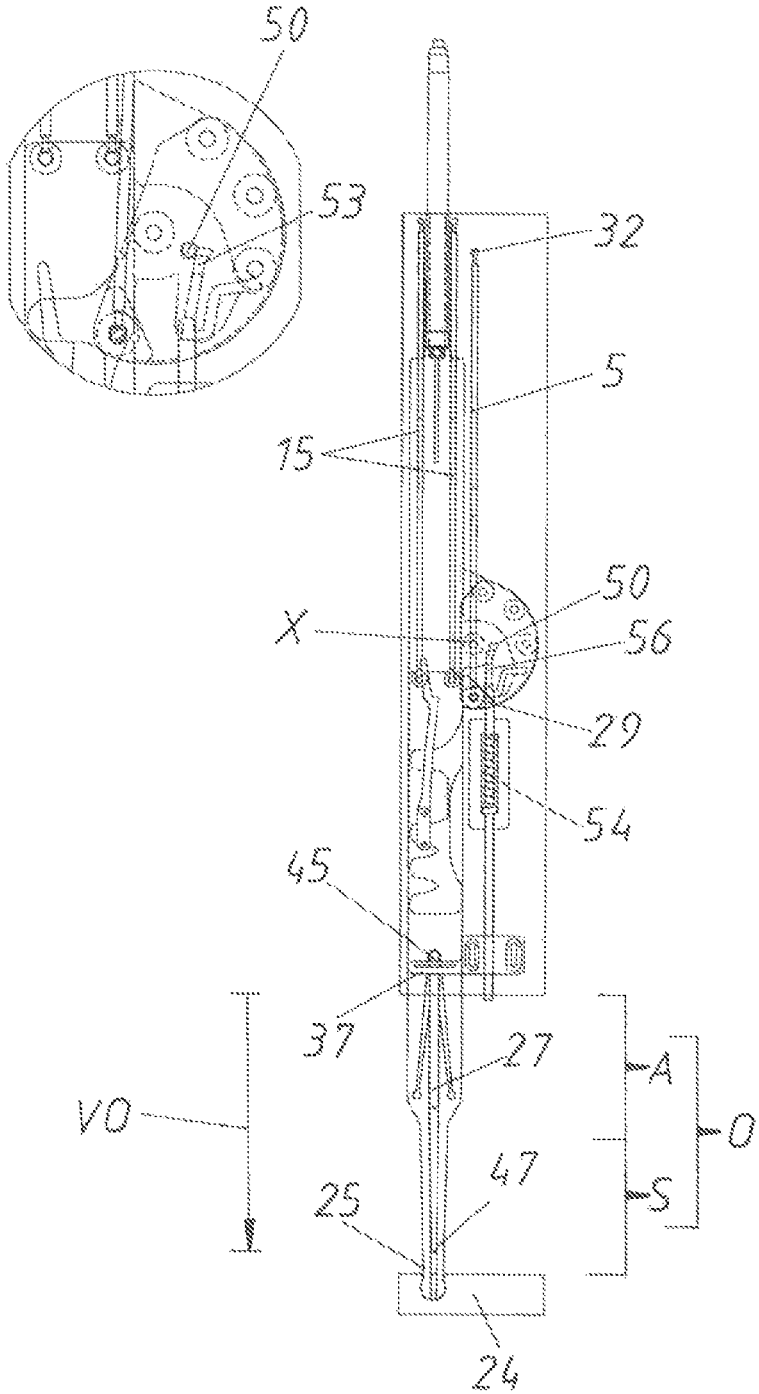
Figure 34:
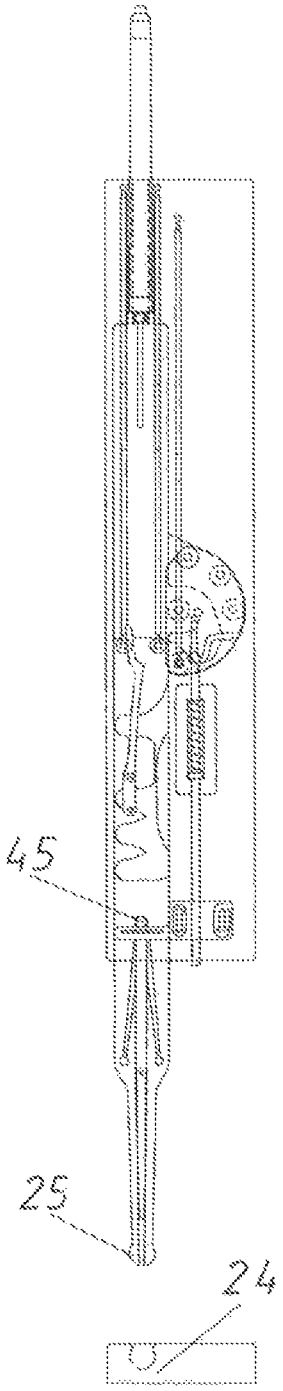

In the case of a further movement, the eccentric pin 50 finally passes the triggering bracket 53, whereby both components again arrive in their starting positions according to FIG. 33. The position of the triggering element 55 is again adapted by the triggering spring 54 in such a way that the triggering element 55 projects from the carrier by the gap size. According to FIG. 33 the tensioning path S is finalized. The tensioning path S together with the ejection path A results in the opening path O of the ejection device 1. During the movement of the ejection device 1 from FIG. 32 to FIG. 33 the abutment 45 of the coupling and decoupling element 27 reaches contact with the head portion 37. The predetermined opening path VO is reached. As a consequence, also this coupling and decoupling element 27 is moved relative to the tensioning element 7 (at the same time the coupling force storage member 40 is being loaded), whereby the tip 47 of the coupling and decoupling element 27 is removed from the head region of the coupling piece 25 and the projections of this head region are no longer spread. Thus, the decoupling position EK of the coupling device 26 is reached. However, there is still a loose connection between the head region of the coupling piece 25 and the receiving region of the coupling counter piece 26.

If now further pulling on the movable furniture part 2 starting from this position according to FIG. 33, the coupling counter piece 24 can be released from the coupling piece 25 by bending the projections of the head region to each other and also the loose connection is repealed.

Figure 35:
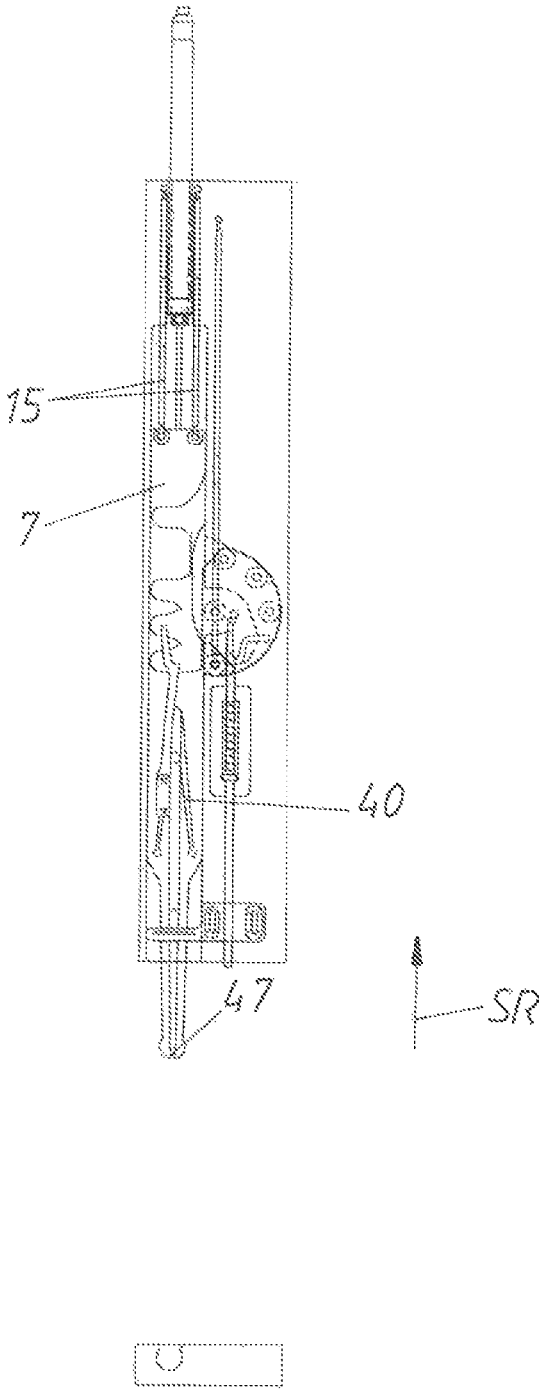

Starting from reaching this decoupling position EK, also the retrieving force storage member 15 can again relax and initially moves the tensioning element 7 in the closing direction SR until reaching the position according to FIG. 35. Simultaneous with this movement or starting from the point in time when the abutment 45 no longer abuts the head portion 37, the coupling force storage member 40 can relax. AS a consequence, the tip 47 of the coupling and decoupling element 27 is moved into the head region of the coupling piece 25, whereby the head region is again being spread.

Figure 36:
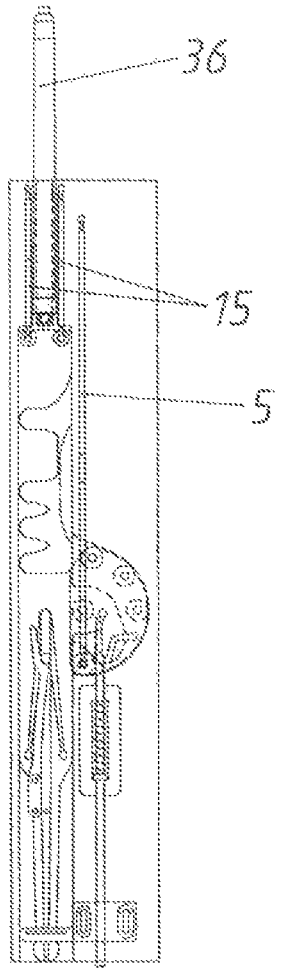

In FIG. 36 the retrieving force storage member 15 has fully relaxed. This retrieving movement is being damped by the piston of the damping device 36. Thereby, the retrieved position R of the retrieving device 13 or the retrieving force storage member 15 is reached. However, the movable furniture part 2—represented by the coupling counter piece 24—is still located in an open position OS.

When finally, according to FIG. 37, even the movable furniture part 2 is being moved in the closing direction SR, the movable furniture part 2 arrives in the closed position SS. In this closed position SS the coupling counter piece 24 again abuts the triggering element 55. The locking device 17 is in the locking position VS. The coupling device 26 is in the decoupling position EK. FIG. 37 corresponds again with the starting position according to FIG. 24.

FIG. 38 shows an item of furniture 21 with a furniture carcass 22 and a movable furniture part 2 in the form of a furniture door. The movable furniture part is pivotally supported on the furniture carcass 22 by means of two hinges 23. A retracting device (not shown) for the movable furniture part 2 can be integrated in one of these hinges 23. An ejection device 1 is arranged on the furniture carcass 22 on a position remote from the hinges 23. In this case it can be seen that the ejection device 1 comprises a coupling piece 25 on an end facing towards the movable furniture part 2. This coupling piece 25 can be coupled with a coupling counter piece 24 arranged on the movable furniture part 2. In this FIG. 38 the movable furniture part 2 is an open position OS.

FIG. 39 shows an exploded view of the ejection device 1. The ejection device 1 comprises the carrier 3 as a base portion. Together with a cover (not shown) the carrier 3 can form a housing for all of the components of the ejection device 1. A sliding guide track 18 for the ejection element 4 is formed in the carrier 3. The control lever 19 is rotatably supported on the ejection element by means of the control lever rotary bearing 31. The control pin 20 is arranged on this control lever 19, in turn. The control pin 20 engages the cardioid-shaped sliding guide track 18. Additionally, a guide track 34 for the tensioning element 7 is formed in the carrier 3. The coupling piece 25 is arranged on the front end of this tensioning element 7. The coupling piece 25 together with the coupling counter piece 24 forms the coupling device 26. Additionally, a coupling and decoupling element 27 together with the coupling force storage member 40 is provided for the coupling and decoupling. This coupling force storage member 40, which is formed as an approximately V-shaped arranged tension spring, is not illustrated in FIG. 39, however, it can be seen starting from FIG. 41. The guide track 28 for the coupling and decoupling element 27 is formed in the carrier 3. Further, a latch 61 for the coupling and decoupling element 27 is provided. The latch 61 is rotatably supported in the bearing 62 and comprises a receiving recess 63 for the projection 64 formed on the coupling and decoupling element 27. The latch abutment 65 is held in the recesses 67 of the carrier 3 by means of the bolts 66.

The ejection force storage member 5 on the one hand is connected to the ejection element 4 by means of the spring base 29 and on the other hand engages the spring base 30 formed in the carrier 3. The spring base 29 is hingedly connected to the ejection element 4 by means of the bolt 68. Moreover, a further control bolt 69 is held in the spring base 29, the control bolt 69 allows a targeted guidance of the spring base 29 in the region 70 of the sliding guide track 18. A gear rack 12 is also formed on the ejection element 4. The tensioning element 7 is movably coupled with the movement transmission element 8. In particular, this movement transmission element 8 is formed as a gear wheel 10 which meshes with the gear rack 11 of the tensioning element 7 and with the gear rack 12 of the ejection element 4. The movement transmission element 8 on the one hand is displaceably supported in the guide track 9 formed in the carrier 3 and on the other hand is rotatably supported in the slider 16. The guide track 9 comprises two end abutments E1 and E2. The slider 16, in turn, is part of the retrieving device 13 for the tensioning element 7. Especially, the retrieving force storage member 15 engages this slider 16. In addition, this retrieving force storage member 15 is fixed on its other end to the spring base 32 formed in the carrier 3.

FIG. 40 shows the ejection device 1 in an assembled state. In this case, the coupling piece 25 is in a loose connection with the coupling counter piece 24. Moreover, it can be seen that the tensioning element 7 together with the movement transmission element 8 forms the tensioning device 6. Additionally, this movement transmission element 8 together with the slider 16 simultaneously forms the retrieving element 14. This retrieving element 14, in turn, together with the retrieving force storage member 15 forms the retrieving device 13. In this FIG. 40 the retrieving force storage member 15—in this formed as a spring, preferably as a tension spring—is in a relaxed position. In contrast, the ejection force storage member 5—which is as well formed as a spring, preferably as a tension spring—is in a tensioned position. The control pin 20 of the locking device 17 is located in the latch recess of the cardioid-shaped sliding guide track 18, whereby the whole ejection device 1 is in the locking position VS.

The FIGS. 41 to 49 each show on the left side a top view onto the ejection device 1 in different positions. The same top view is shown on each right side, wherein also the actually not visible components located beneath are indicated by dashed lines.

Figure 41:
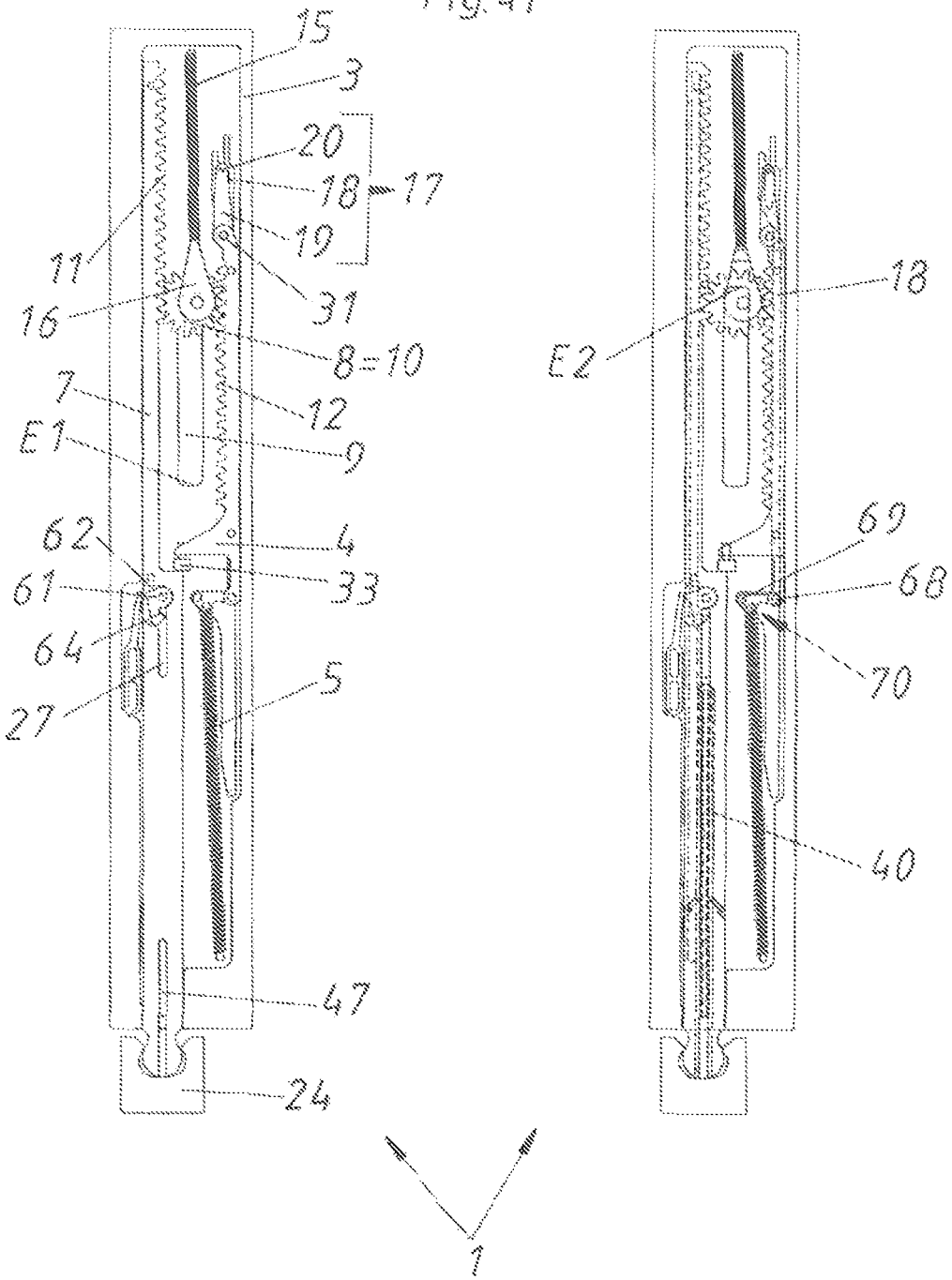

In FIG. 41 the ejection device 1 is in the same position as in FIG. 40, that is to say in the locking position VS. Additionally, the movable furniture part 2 (not shown here) is in the closed position SS. This closed position SS is represented by the coupling counter piece 24, which is indeed attached to the movable furniture part 2. In this locking position VS the tensioning element 7 abuts the ejection element 4 by means of the buffering element 33. The control pin 20 arranged on the control lever 19 is located in the latch recess of the cardioid-shaped sliding guide track 18 of the locking device 17. The ejection force storage member 5 is tensioned, whereas the retrieving force storage member 15 is relaxed. The latch 61 encompasses the projection 64 via its receiving recess 63, whereby the coupling and decoupling element 27 with its tip 47 is located in a retracted position from the head region of the coupling piece 25. The coupling force storage member 40 is tensioned in this position. The coupling force storage member 40 is held in the tensioning element 7 with its two ends and abuts the coupling and decoupling element 27 in a central region. The coupling device 26 is in the coupling position EK, in which the coupling piece 25 and the coupling counter piece 24 are loosely connected to teach other.

Figure 42:
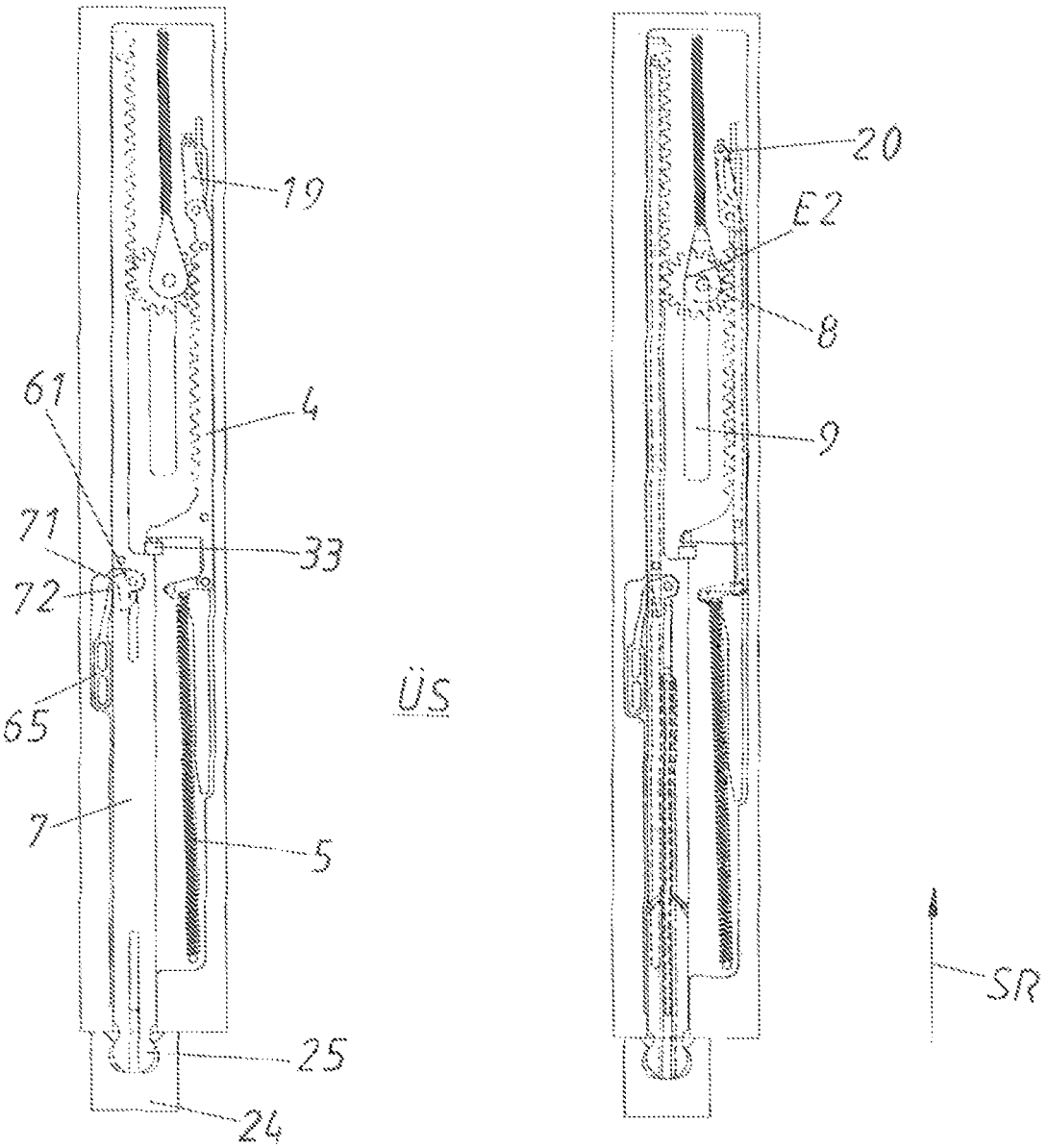
Figure 43:
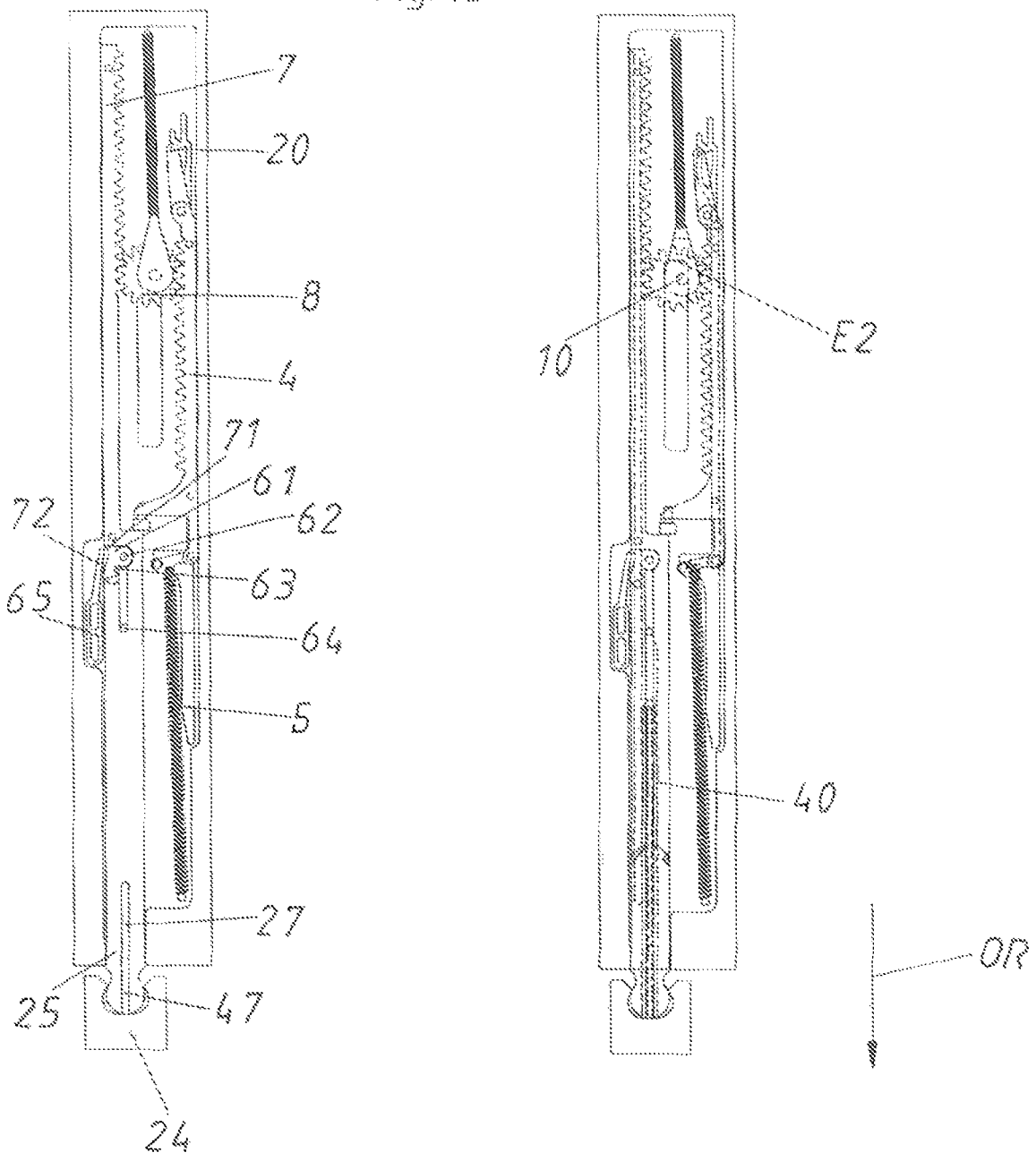

When pressing onto the movable furniture part 2 in the closing direction SR starting form this closed position SS according to FIG. 41, the ejection device 1 arrives in the over-pressing position US according to FIG. 42. By this over-pressing movement the tensioning element 7 is being moved in the closing direction SR via the coupling counter piece 24 and the coupling piece 25. Via the buffering element 23, also the ejection element 4 is moved against the force of the ejection force storage member 5 in the closing direction SR, whereby the control lever 19 and especially its control pin 20 is removed from the latch recess of the cardioid-shaped sliding guide track 18 and reaches the ejection section of the sliding guide track 18 by means of a corresponding deflection slope. As a consequence, the ejection element 4 is no longer locked in the carrier 3 via the locking device 17 but is in an unlocking state ES. On the right side it can be seen that also the movement transmission element 8 has been moved to the end abutment E2 of the guide track 9 by this over-pressing movement. Also the latch 61 has been moved relative to the latch abutment 65 by this over-pressing movement, wherein the projection 71 of the latch 61 has passed the—in the case of a lateral force actuating direction—resilient end 72 of the latch abutment 65.

As soon as a user releases the movable furniture part 2 starting from this position according to FIG. 42, the ejection force storage member 5 can relax. As a consequence, the ejection device 1 initially reaches the position according to FIG. 43, which corresponds to a slightly opened open position OS of the movable furniture part 2. It can be seen that the control pin 20 in its unlocking state ES has already moved a bit in the opening direction OR through the ejection section of the sliding guide track. As the ejection force storage member 5 pulls the ejection element 4, also this ejection element 4 is moved in the opening direction OR relative to the carrier 3. As additionally the ejection element 4 abuts the tensioning element 7 via the buffering element 33, also this tensioning element 7 is moved in the opening direction OR. As furthermore the movement transmission element 8 is movably supported in the guide track 9, the ejection element 4, the movement transmission element 8 and the tensioning element 7 are commonly moved relative to the carrier 3 over this first part of the ejection path A. Also the latch 61 arranged on the tensioning element 7 is carried by this movement of the tensioning element 7 in the opening direction OR, whereby the projection 71 abuts the—in the case of a frontal force actuating direction—rigid end 72 of the latch abutment 65. As a consequence, a clockwise rotational movement of the latch 61 about the bearing 62 is initiated. The projection 64, thus, is no longer held in the receiving recess 63 of the latch 61. Thereby, the coupling force storage member 40 has already relaxed according to FIG. 43 and the coupling and decoupling element 27 together with its tip 47 has moved into the head region of the coupling piece 25. As a consequence, the projections of the head region distanced from each other cannot be bent towards each other and the coupling position K of the coupling device 26 in the form of a positive-locking engagement between the coupling piece 25 and the coupling counter piece 24 is reached.

Figure 44:
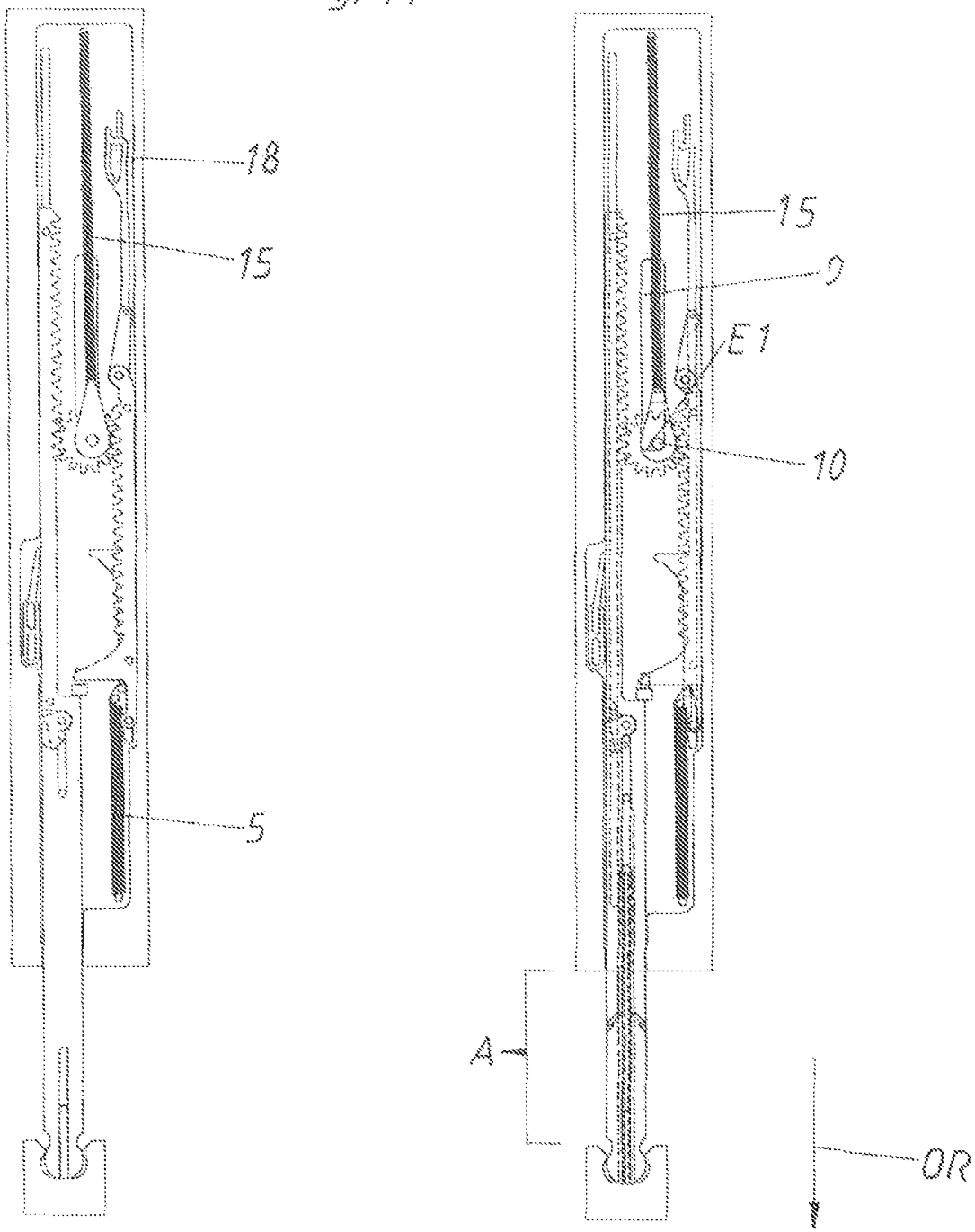

In FIG. 44 the ejection device 1 has already travelled the ejection path A. The ejection force storage member 5 has relaxed. The movement transmission element 8 in the form of a gear wheel 10 abuts the end abutment E1 of the guide track 9. Also the retrieving force storage member 15 has been relaxed with this ejection movement of the ejection element 4 and the co-movement of the movement transmission element 8.

Figure 45:
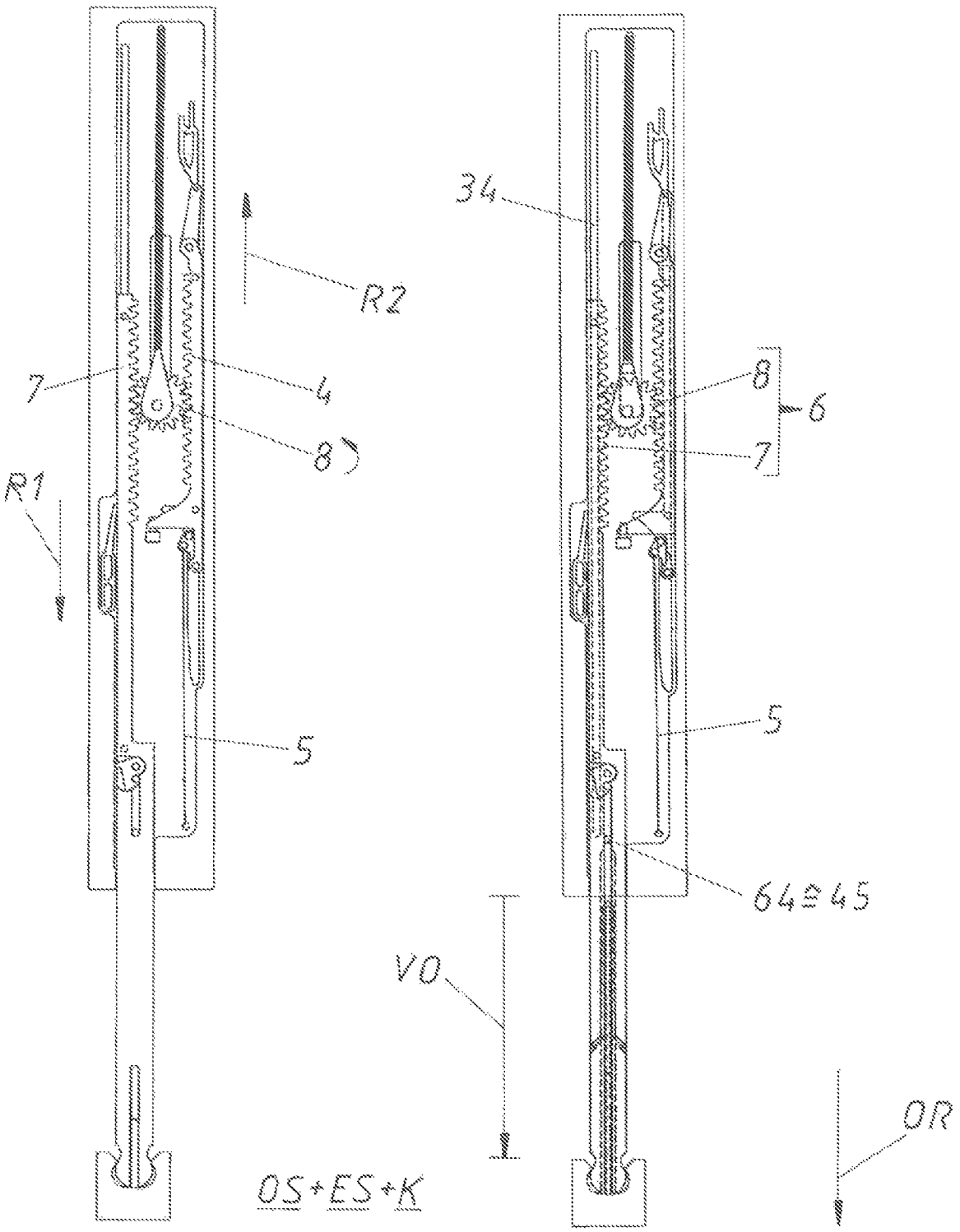

As starting from the open position OS according to FIG. 44 the movement transmission element 8 can no longer be co-moved in the opening direction OR with the tensioning element 7 because the movement transmission element 8 abuts the end abutment E1 of the guide track 9, a relative movement between the tensioning element 8 and the movement transmission element 8 takes place by further pulling the movable furniture part 2 in the opening direction OR according to FIG. 45. Concretely, the tensioning element 8 is further moved in the direction R1, whereby the movement transmission element 8 rotates counterclockwise. Due to this rotation of the movement transmission element 8, the ejection element 4 is moved in the opposite direction R2 by means of the gear rack 12. As a consequence, also the ejection force storage member 5 is again tensioned. Thus, the tensioning element 7 together with the movement transmission element 8 forms the tensioning device 6 for the ejection force storage member 5. This ejection force storage member 5 is (partly) illustrated as a continuous line in a mere schematic manner in FIG. 45 and also in the FIGS. 46, 47 and 50 in order to demonstrate the length. In FIG. 45 the projection 64, which simultaneously forms an abutment 45 for the coupling and decoupling element 27, abuts the carrier 3. Thus, the predetermined opening path VO is reached. If now further pulling the movable furniture part 2 in the opening direction OR, the coupling and decoupling element 27 cannot move together with the tensioning element 7 forming the coupling piece 25.

Figure 46:
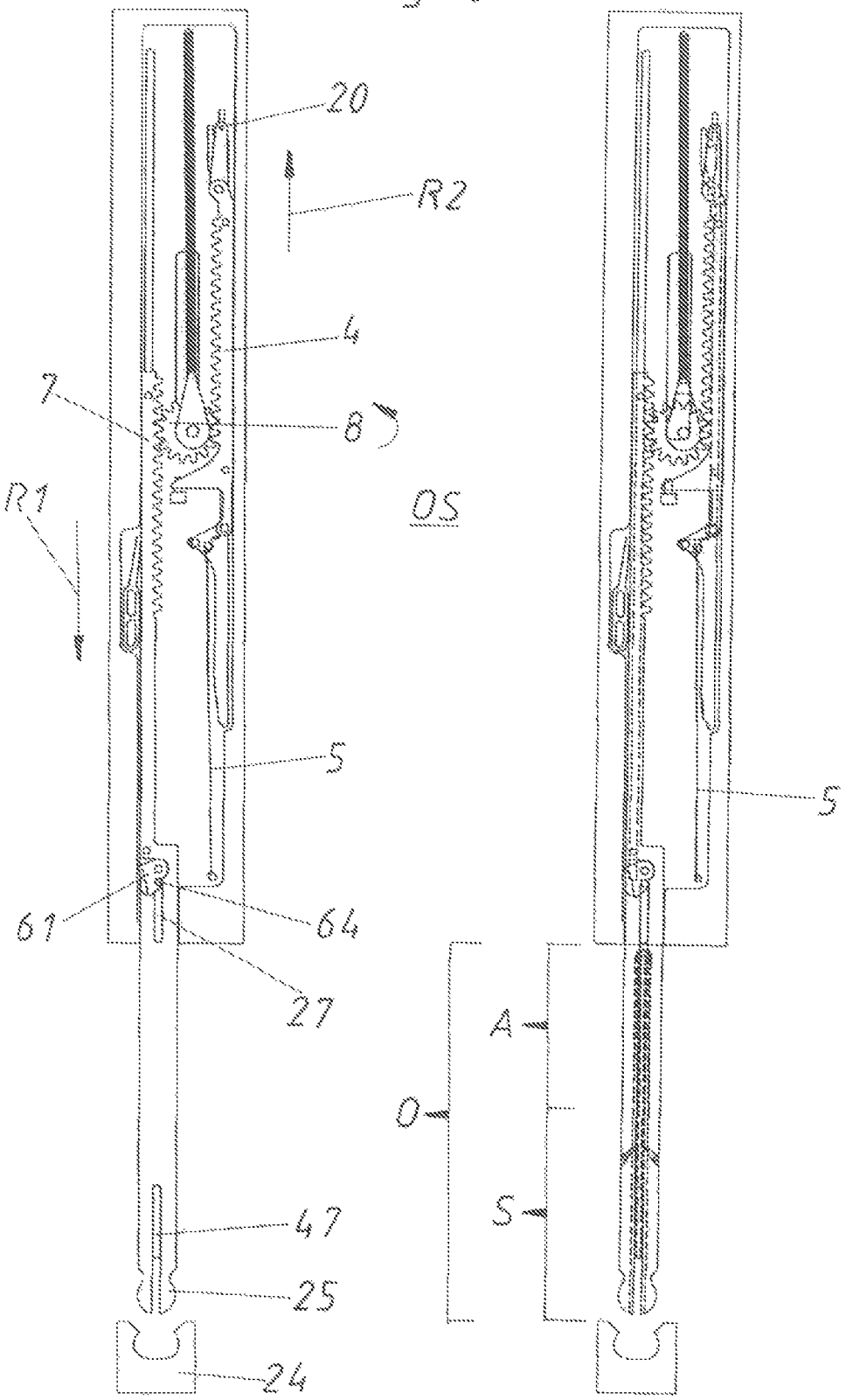

According to FIG. 46 this tensioning movement via the tensioning element 7 has continued so far that tip 47 of the coupling and decoupling element 27 has been completely removed from the head region of the coupling piece 25, whereby the coupling device 26 is decoupled (decoupling position EK) so that the coupling counter piece 24 and, thus, the movable furniture part 2 is no longer coupled to the ejection device 1. The projection 64 is again held in the receiving recess 63 of the latch 61. The coupling force storage member 40 is again loaded. By this tensioning movement also the control lever 20 has again moved in a position of the sliding guide track 20 located behind the latch recess. In FIG. 46 the whole opening path O has been travelled by the ejection device 1. The opening path O consists of the ejection path A and the subsequent tensioning path S. According to FIG. 46 the movable furniture part 2 can now be freely moved.

Figure 47:
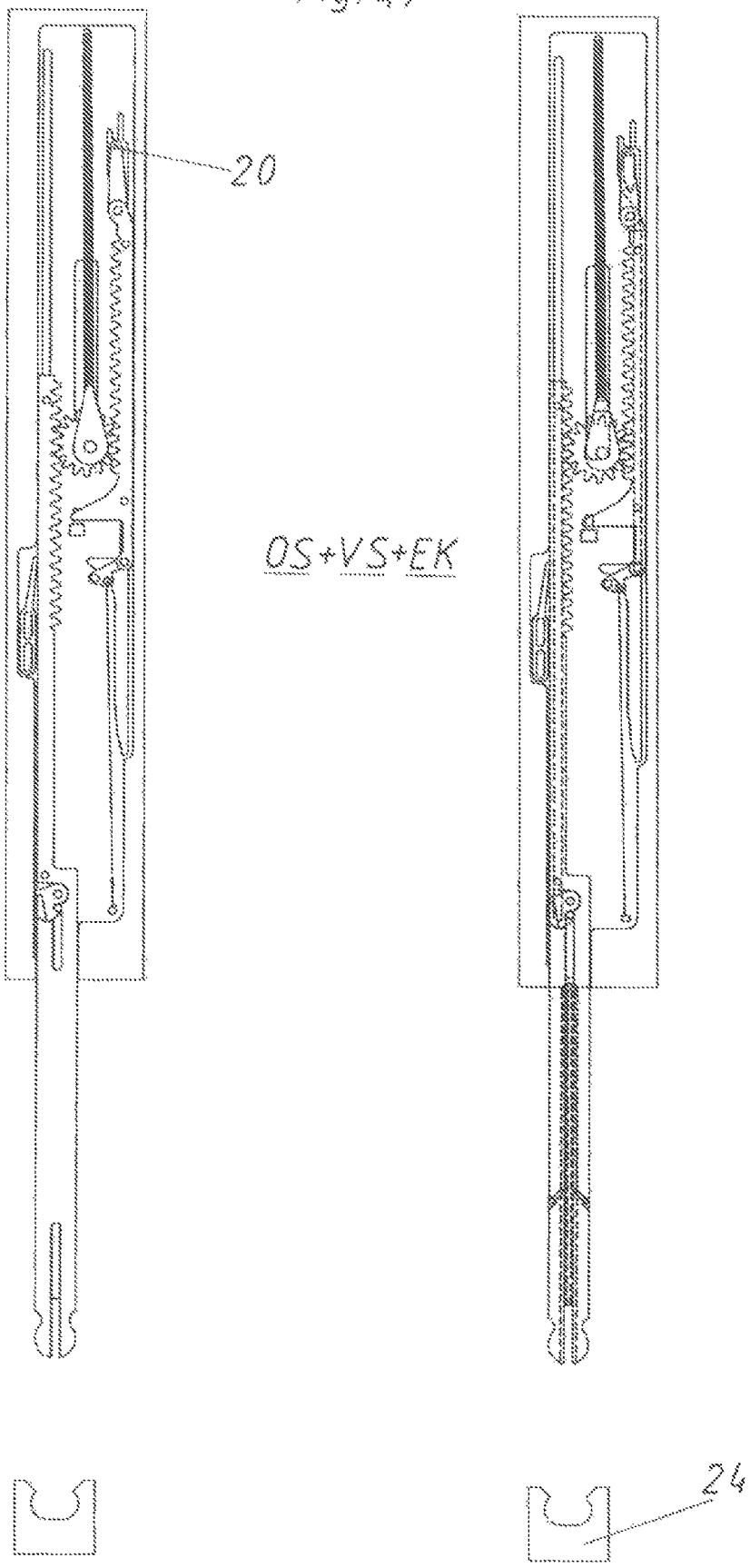

As now no more forces are acting from the movable furniture part 2 onto the ejection device 1 (i. e. the tensioning element 7 and thus the ejection element 4 is no longer actively pulled), the ejection force storage member 5 can again shortly and slightly relax until the control pin 20 latches in the latch recess of the cardioid-shaped sliding guide track 18 according to FIG. 47. The locking position VS of the locking device 17 and the ejection element 4 respectively, thus, is reached.

Thereafter, the retrieving force storage member 15 starts to relax according to FIG. 48. As this retrieving force storage member 15 pulls the slider 16 of the retrieving element 14 and as at the same time the ejection element 4, however, is fixed because of the locking of the locking device 17, the movement transmission element 8 in the form of the gear wheel 10 on the one hand starts being displaced in the guide track 9 in the direction R2 and on the other hand starts to rotate clockwise in the slider 16. Also the tensioning element 7 is being moved in this case double as fast as the movement transmission element 8 in the direction R2 by this rotation of the movement transmission element 8. The movable furniture part 2 is still in the open position OS, whereas the ejection device 1 is already in the locking position VS of the locking device 17.

In FIG. 49 the retrieving force storage member 15 has fully relaxed, whereby the tensioning element 7 again abuts the ejection element 4. In this case, the impact of the tensioning element 7 on the ejection element 4 is damped by the buffering element 33. The tensioning element 7 is thereby being moved into the retrieved position R by means of the retrieving device 13. In contrast to FIG. 41, in FIG. 49 the movable furniture part 2 is still in the open position OS. If the movable furniture part 2 is being manually closed again starting from this open position OS, the coupling counter piece 24 again arrives in a loose connection to the coupling piece 25 in the last closing section, whereby the position according to FIG. 41 would again be reached.

In FIG. 50 the individual positions according to the FIGS. 41 to 49 are once again illustrated overseeable in a sequence. In a comparison of the third image with the fourth image of this FIG. 50 it can be seen how according to the invention the ejection element 4, the movement transmission element 8 and the tensioning element 8 are commonly movable over the ejection path A relative to the carrier 3.

The fourth variant of the coupling device 26 can be analogously used in the same manner with the ejection devices 1 according to the first three embodiments. The only substantial difference is that during the decoupling movement the coupling and decoupling element 27 is being moved relative to the coupling piece 25 in the opening direction OR and not in the closing direction SR.

FIG. 51*a* shows a side view of a coupling device 26 without the remaining parts of an ejection device 1. This coupling device 26 according to FIG. 51*a* is in a coupling position K. The coupling piece 25 comprises a coupling front portion 74, a coupling housing 75 and a coupling rear portion 76. The coupling and decoupling element 27 is guided in this coupling piece 25. The first coupling arm 77 is hingedly attached to the coupling rear portion 76. This first coupling arm 77 is hingedly connected to the second coupling arm 79 by means of the rotary joint 78. This second coupling arm 79, in turn, is hingedly connected to the coupling and decoupling element 27. In the detail according to FIG. 51*b* it can be seen that the coupling piece 25 in its head region comprises two projections distances from each other. A spreading element 73 is arranged on the widened tip 47 of the coupling and decoupling element 27. The spreading surfaces of the spreading element 73 abut inner surfaces of the projections of the head region of the coupling piece 25 and push them apart. As a consequence, these projections abut corresponding counter surfaces in the receiving region of the coupling counter piece 24 and a positive-locking engagement is given.

In FIG. 52*a* the coupling device has been switched by the control device depending on the opening path O. Concretely, when reaching a predetermined opening path VO, the second coupling arm 79 has been pivoted by means of an abutment (e. g. in the region of the furniture carcass 22 or the carrier 3), so that the coupling and decoupling element 27 is being pushed relative to the coupling piece 25 in the opening direction OR. Thus, also the spreading element 73 arranged on the tip 47 as can be seen in the detail according to FIG. 52*b* has been pushed relative to the projections in the opening direction OR of the coupling piece 25, whereby these projections can no longer be spread. The decoupling position EK of the coupling device 26 is reached. However, the coupling piece 25 and the coupling counter piece 24 are still in a loose connection to each other. Moreover, in the detail according to FIG. 52*b* in can be seen that the narrowest portion of the receiving region of the coupling counter piece 24 is just as wide that the spreading element 73 and also the projections of the head region of the coupling piece 25 can pass through. Thus, there is no longer a positive-locking engagement.

FIG. 53*a* finally shows that, in the case of a further opening movement of the movable furniture part 2, the coupling counter piece 24 can be lifted from the coupling piece 25 as there is no longer a positive-locking engagement between the projections of the head region of the coupling piece 25 and the receiving region of the coupling counter piece 24.

Lastly, it shall be pointed out that in the embodiments the same functional components are referred to with the same reference signs. So, the advantages and mentioned possibilities to the embodiments each analogously apply to the other embodiments.

The invention claimed is:

1. A furniture item comprising:

a furniture carcass;

a movable furniture part; and an ejection device for ejecting the movable furniture part from a closed position to an open position along an opening path, the ejection device comprising:

a carrier;

a coupling device for coupling the ejection device to the movable furniture part, the coupling device comprising a coupling piece that is movable relative to the carrier and a coupling counter piece that is on the movable furniture part, the coupling device having a coupling position and a decoupling position, and the ejection device being couplable to the movable furniture part via the coupling device in the coupling position;

an ejection element for ejecting the movable furniture part from the closed position into the open position by rotating;

an ejection force storage member for force-actuating the ejection element in an opening direction of the movable furniture part; and a control device comprising a coupling and decoupling element including an abutment, the control device being configured to switch the coupling device between the coupling position and the decoupling position depending on the opening path, the coupling device reaching the decoupling position from the coupling position in the event of reaching an end of the opening path, wherein the coupling and decoupling element is movable relative to the coupling piece, wherein the coupling piece is movable together with the coupling and decoupling element relative to the carrier during the opening movement until reaching the end of the opening path, and, upon reaching the end of the opening path, the coupling and decoupling element is fixed relative to the carrier with the abutment abutting on the carrier and the coupling piece is movable relative to the coupling and decoupling element and relative to the carrier in the opening direction when the coupling and decoupling element abuts the carrier via the abutment, and wherein the coupling and decoupling element and the coupling piece are associated with the furniture carcass.

2. The furniture item according to claim 1, wherein in the coupling position there is a positive-locking engagement between the coupling piece and the coupling counter piece, wherein this positive-locking engagement is releasable by the control device.

3. The furniture item according to claim 1, wherein the coupling piece includes at least one head region that is spreadable by the coupling and decoupling element.

4. The furniture item according to claim 3, wherein in the case of the head region of the coupling piece being spread open, the coupling piece and the coupling counter piece are in the coupling position because of a positive-locking engagement between the head region of the coupling piece and a receiving region of the coupling counter piece.

5. The furniture item according to claim 3, wherein in the case of the head region of the coupling piece not being spread open, the coupling piece and the coupling counter piece are in the decoupling position because of a loose connection between the head region of the coupling piece and a receiving region of the coupling counter piece.

6. The furniture item according to claim 1, further comprising a locking device for locking the ejection element in a locking position, wherein the locking device can be unlocked by over-pressing the movable furniture part into an over-pressing position behind the closed position.

7. The furniture item according to claim 1, wherein the ejection device further comprises a tensioning device for tensioning the ejection force storage member.

8. The furniture item according to claim 7, wherein the coupling piece of the coupling device is connected to the tensioning device.

9. The furniture item according to claim 7, wherein the ejection device further comprises a retrieving device comprising a retrieving force storage member for moving the tensioning device into a retrieved position.

10. The furniture item according to claim 1, wherein in the decoupling position the movable furniture part is released from the coupling device.

11. A furniture item comprising:

a furniture carcass;

a movable furniture part; and an ejection device for ejecting the movable furniture part from a closed position to an open position along an opening path, the ejection device comprising:

a carrier;

a coupling device for coupling the ejection device to the movable furniture part, the coupling device comprising a coupling piece that is movable relative to the carrier and a coupling counter piece that is on the movable furniture part, the coupling device having a coupling position and a decoupling position, and the ejection device being couplable to the movable furniture part via the coupling device in the coupling position; and a control device comprising a coupling and decoupling element, the control device being configured to switch the coupling device between the coupling position and the decoupling position depending on the opening path, the coupling device reaching the decoupling position from the coupling position in the event of reaching an end of the opening path, wherein the coupling and decoupling element and the coupling piece are coupled to the furniture carcass and uncoupled from the movable furniture part when the coupling device is in the decoupling position, wherein the coupling and decoupling element is movable relative to the coupling piece, and wherein the coupling piece includes at least one head region that is spreadable by the coupling and decoupling element.

12. The furniture item according to claim 11, wherein in the case of the head region of the coupling piece being spread open, the coupling piece and the coupling counter piece are in the coupling position because of a positive-locking engagement between the head region of the coupling piece and a receiving region of the coupling counter piece.

13. The furniture item according to claim 11, wherein in the case of the head region of the coupling piece not being spread open, the coupling piece and the coupling counter piece are in the decoupling position because of a loose connection between the head region of the coupling piece and a receiving region of the coupling counter piece.

14. A furniture item comprising:

a furniture carcass;

a movable furniture part; and an ejection device for ejecting the movable furniture part from a closed position to an open position along an opening path, the ejection device comprising:

a carrier;

a coupling device for coupling the ejection device to the movable furniture part, the coupling device comprising a coupling piece that is movable relative to the carrier and a coupling counter piece that is on the movable furniture part, the coupling device having a coupling position and a decoupling position, and the ejection device being couplable to the movable furniture part via the coupling device in the coupling position; and a control device comprising a coupling and decoupling element, the control device being configured to switch the coupling device between the coupling position and the decoupling position depending on the opening path, the coupling device reaching the decoupling position from the coupling position in the event of reaching an end of the opening path, wherein the coupling and decoupling element and the coupling piece are associated with the furniture carcass, wherein the coupling and decoupling element is movable relative to the coupling piece, and wherein the coupling piece includes at least one head region that is spreadable by the coupling and decoupling element, the at least one head region being configured to maintain a spread position when in the coupling position.

* * * * *